US007438029B2

(12) United States Patent
Fox et al.

(10) Patent No.: US 7,438,029 B2
(45) Date of Patent: Oct. 21, 2008

(54) PISTON WAVEFORM SHAPING

(75) Inventors: John Fox, Upton, MA (US); Albert E. Sanderson, Carlisle, MA (US); Robert A. Sanderson, Denton, TX (US)

(73) Assignee: R. Sanderson Management, Inc., Denton, TX (US)

( * ) Notice: Subject to any disclaimer, the term of this patent is extended or adjusted under 35 U.S.C. 154(b) by 658 days.

(21) Appl. No.: 10/944,822

(22) Filed: Sep. 21, 2004

(65) Prior Publication Data

US 2005/0207907 A1 Sep. 22, 2005

Related U.S. Application Data

(60) Provisional application No. 60/553,969, filed on Mar. 18, 2004.

(51) Int. Cl.

| | |
|---|---|
| ***F02B 75/04*** | (2006.01) |
| ***F02B 75/18*** | (2006.01) |
| ***F02B 28/07*** | (2006.01) |
| ***F01B 13/04*** | (2006.01) |
| ***F04B 27/08*** | (2006.01) |

(52) U.S. Cl. ..... 123/56.1; 123/48 B; 74/47; 74/60; 91/505; 92/12.2; 92/71; 417/269

(58) Field of Classification Search ..... 123/56.1, 123/56.3, 62, 63, 78 R; 91/505; 92/12.2, 92/71; 74/47, 60, 839; 417/222.1, 216, 269, 417/270, 426

See application file for complete search history.

(56) References Cited

U.S. PATENT DOCUMENTS 748,559 A 12/1903 Peet 812,636 A 2/1906 Callan (Continued)

FOREIGN PATENT DOCUMENTS

DE 1451926 5/1965

(Continued)

OTHER PUBLICATIONS

International Search Report mailed Aug. 16, 2005 from International Application No. PCT/US2005/009295 filed Mar. 17, 2005.

(Continued)

*Primary Examiner*—Noah Kamen
(74) *Attorney, Agent, or Firm*—Fish & Richardson P.C.

(57) ABSTRACT

An assembly includes at least one piston, a rotating member, a transition arm, and a mechanism. The transition arm is configured to translate between rotational movement of the rotating member and a first linear motion of the piston. The mechanism is configured to superimpose a second linear motion of the piston onto the first linear motion of the piston. The assembly can be a hydraulic (or air) pump or hydraulic (or air) motor, with the second linear motion resulting in reduced output ripple or smooth torque vs. angular rotation, respectively. Also, the assembly can be an alternator or electric motor, with the additional linear motion resulting in an ac waveform that conforms substantially to a sinewave or a back emf that conforms to the input voltage or electric waveform. In addition, the assembly can be an internal combustion engine in which the second linear motion results in the pistons lingering about top dead center during the combustion process.

42 Claims, 28 Drawing Sheets

U.S. PATENT DOCUMENTS

| | | | | |
|---|---|---|---|---|
| 1,019,521 | A | | 3/1912 | Pratt |
| RE15,442 | E | | 9/1922 | Almen |
| 1,648,000 | A | | 11/1927 | Lee |
| 1,968,470 | A | | 7/1934 | Szombathy |
| 2,048,272 | A | | 7/1936 | Linthicum |
| 2,155,455 | A | * | 4/1939 | Thoma ..... 91/489 |
| 2,256,079 | A | | 9/1941 | Dinzl |
| 2,465,510 | A | | 3/1949 | Bonnafe |
| 2,513,083 | A | | 6/1950 | Eckert |
| 2,532,254 | A | | 11/1950 | Bouchard |
| 2,539,880 | A | | 1/1951 | Wildhaber |
| 2,653,484 | A | | 9/1953 | Zecher |
| 2,737,895 | A | | 3/1956 | Ferris |
| 2,827,792 | A | | 3/1958 | Hopkins |
| 2,940,325 | A | | 6/1960 | Nakesch |
| 3,077,118 | A | | 2/1963 | Robbins |
| 3,273,344 | A | | 9/1966 | Christenson |
| 3,292,554 | A | | 12/1966 | Hessler |
| 3,842,440 | A | | 10/1974 | Karlson |
| 3,861,829 | A | | 1/1975 | Roberts et al. |
| 3,877,839 | A | | 4/1975 | Ifield |
| 3,956,942 | A | | 5/1976 | Seki et al. |
| 3,959,983 | A | | 6/1976 | Roberts et al. |
| 3,974,714 | A | | 8/1976 | Fritsch |
| 4,011,842 | A | | 3/1977 | Davies et al. |
| 4,066,049 | A | | 1/1978 | Teodorescu et al. |
| 4,077,269 | A | | 3/1978 | Hodgkinson |
| 4,094,202 | A | | 6/1978 | Kemper |
| 4,100,815 | A | | 7/1978 | Kemper |
| 4,144,771 | A | | 3/1979 | Kemper et al. |
| 4,152,944 | A | | 5/1979 | Kemper |
| 4,168,632 | A | | 9/1979 | Fokker |
| 4,174,684 | A | | 11/1979 | Roseby et al. |
| 4,178,135 | A | | 12/1979 | Roberts |
| 4,294,139 | A | | 10/1981 | Bex et al. |
| 4,297,085 | A | | 10/1981 | Brucken |
| 4,418,586 | A | | 12/1983 | Maki et al. |
| 4,433,596 | A | | 2/1984 | Scalzo |
| 4,449,444 | A | | 5/1984 | Forster |
| 4,780,060 | A | | 10/1988 | Terauchi |
| 5,002,466 | A | | 3/1991 | Inagaki et al. |
| 5,007,385 | A | | 4/1991 | Kitaguchi |
| 5,049,799 | A | | 9/1991 | Tsai et al. |
| 5,063,829 | A | | 11/1991 | Takao et al. |
| 5,076,769 | A | | 12/1991 | Shao et al. |
| 5,113,809 | A | | 5/1992 | Ellenburg |
| 5,336,056 | A | | 8/1994 | Kimura et al. |
| 5,437,251 | A | | 8/1995 | Anglim et al. |
| 5,553,582 | A | | 9/1996 | Speas |
| 5,699,716 | A | | 12/1997 | Ota et al. |
| 5,782,219 | A | | 7/1998 | Frey et al. |
| 5,785,503 | A | | 7/1998 | Ota et al. |
| 5,897,298 | A | | 4/1999 | Umemura |
| 6,279,520 | B1 | * | 8/2001 | Lowi, Jr. ..... 123/56.1 |
| 6,397,794 | B1 | | 6/2002 | Sanderson et al. |
| 6,446,587 | B1 | | 9/2002 | Sanderson et al. |
| 6,460,450 | B1 | | 10/2002 | Sanderson et al. |
| 6,829,978 | B2 | | 12/2004 | Sanderson et al. |
| 2002/0059907 | A1 | | 5/2002 | Thomas |
| 2002/0106238 | A1 | | 8/2002 | Sanderson et al. |
| 2002/0194987 | A1 | | 12/2002 | Sanderson et al. |
| 2003/0084785 | A1 | | 5/2003 | Sanderson et al. |
| 2003/0138331 | A1 | | 7/2003 | Sanderson et al. |

FOREIGN PATENT DOCUMENTS

| | | | |
|---|---|---|---|
| DE | 20 30 978 | A1 | 1/1971 |
| DE | 2612270 | | 9/1977 |
| DE | 3420529 | | 12/1985 |
| DE | 199 39 131 | A1 | 3/2001 |
| FR | 461343 | | 12/1913 |
| FR | 1 015 857 | | 10/1952 |
| FR | 2 300 262 | | 2/1975 |
| FR | 2453332 | | 4/1979 |
| GB | 121961 | | 1/1920 |
| GB | 801 952 | | 9/1958 |
| JP | 60-164677 | | 8/1985 |
| WO | WO 99/14471 | | 3/1999 |
| WO | WO 00/15955 | | 3/2000 |
| WO | WO 01/11214 | | 2/2001 |
| WO | WO 01/11237 | | 2/2001 |
| WO | WO 01/12989 | A1 | 2/2001 |
| WO | WO 02/063139 | | 8/2002 |
| WO | WO 03/085259 | | 10/2003 |
| WO | WO 03/100231 | | 12/2003 |

OTHER PUBLICATIONS

Written Opinion of International Searching Authority mailed Aug. 16, 2005 from International Application No. PCT/US2005/009295 filed Mar. 17, 2005.

* cited by examiner

PISTON WAVEFORM SHAPING

This application claims priority under 35 USC §119(e) to U.S. Patent Application Ser. No. 60/553,969, filed on Mar. 18, 2004, the entire contents of which are hereby incorporated by reference.

BACKGROUND

This description relates to piston waveform shaping.

In a number of devices (e.g., hydraulic pumps or motors, air compressors or motors, alternators, electric engines, and internal combustion engines), the motion of a piston is used to impart rotation to a flywheel, or vice versa. In piston assemblies such as those discussed in PCT Application WO 03/100231 filed May 27, 2003 and incorporated herein by reference in its entirety, the motion of the pistons is linear in space and sinusoidal in time (i.e., simple harmonic motion), such that a piston's motion and velocity waveforms are generally sinusoidal.

SUMMARY

In one aspect, an assembly includes at least one piston, a rotating member, a transition arm, and a mechanism. The transition arm is coupled to the at least one piston and the rotating member to translate between rotational movement of the rotating member and a first linear motion of the piston. The mechanism is configured to superimpose a second linear motion of the piston onto the first linear motion of the piston.

Implementations of this aspect may include one or more of the following features. The at least one piston includes three pistons. The transition arm includes a nose pin and is coupled to the pistons such that the pistons are arranged circumferentially about the transition arm. The nose pin is coupled to the rotating member off-axis of the rotating member to form an angle between the transition arm and a rotation axis of the rotating member such that rotational movement of the rotating member is translated into a first linear motion of each piston.

The mechanism includes a cam and a cam follower. The cam follower is coupled to the rotating member and the transition arm and configured to engage the cam during rotational movement of the rotating member.

In one illustrated implementation, the mechanism includes a pivot member. The pivot member couples the cam-follower to the rotating member and the transition arm and is configured to linearly move the transition arm as the cam-follower engages the cam during rotational movement of the rotating member. The linear movement of the transition arm results in the second linear motion superimposed on the first linear motion of the piston.

The cam is substantially cylindrical and mounted substantially co-axially with the rotation axis. The cam includes a cam profile that varies along the rotation axis. The pivot member is coupled to the rotating member and couples the nose pin to the rotating member. The cam-follower is coupled to the pivot member such that the pivot member pivots as the cam-follower engages the cam profile during rotational movement of the rotating member. The pivoting of the pivot member linearly moves the transition arm to result in the second linear motion of the piston.

In another illustrated implementation, the mechanism includes a bearing block. The bearing block couples the cam-follower to the rotating member and the transition arm and is configured to angularly move the transition arm as the cam-follower engages the cam during rotational movement of the rotating member. The angular movement of the transition arm results in the second linear motion superimposed on the first linear motion of the piston.

The cam is substantially cylindrical and mounted substantially co-axially with the rotation axis of the rotating member. The cam includes a cam profile that varies along an axis perpendicular to the rotation axis. The bearing block is housed in an arced channel defined by the rotating member and couples the nose pin to the rotating member. The cam-follower is coupled to the bearing block such that the bearing block slides in the arced channel as the cam-follower engages the cam profile during rotational movement of the rotating member. The sliding of the bearing block causes the angular movement of the transition arm that results in the second linear motion of the piston.

In another illustrated implementation, the mechanism includes a push/pull cylinder coupled to the transition arm. The push/pull cylinder is configured to linearly move the transition arm during rotational movement of the rotating member. The linear movement of the transition arm results in the second linear motion superimposed on the first linear motion of the piston. A computer is configured to control the push/pull cylinder to linearly move the transition arm. A control rod adjusts the piston stroke of the piston and the computer is configured to control the push/pull cylinder to linearly move the transition arm based on the piston stroke of the piston. The control rod is coupled to a bearing block such that movement of the control rod slides the bearing block in an arced channel of the rotating member to change the angle between the transition arm and the rotational axis. The change in angle between the transition arm and the rotational axis changes the piston stroke of the pistons.

The assembly is adapted to operate as an air compressor or motor; an alternator; an electric motor; an internal combustion engine; or a hydraulic motor or pump. When adapted to act as an air compressor, the first linear motion and the second linear motion resulting in a combined linear motion of the piston that reduces ripple in an output of the air compressor. When adapted to act as an air motor, the first linear motion and the second linear motion result in a combined linear motion of the piston that reduces ripple in an output torque of the air motor. When adapted to act as an alternator, the first linear motion and the second linear motion result in a combined linear motion of the piston that conforms substantially to that of a true sine wave. When adapted to act as an electric motor, the first linear motion and the second linear motion result in a combined linear motion of the piston that creates substantially sinusoidal back emf. When adapted to act as an internal combustion engine, the first linear motion and the second linear motion result in a combined linear motion of the piston in which the piston is stationary at top dead center while the combustion process is completed. When adapted to act as a hydraulic pump, the first linear motion and the second linear motion result in a combined linear motion of the piston that reduces ripple in an output of the hydraulic pump.

In another aspect, a method includes superimposing a second linear motion onto a first linear motion of a piston in an assembly.

Implementations of this aspect may include one or more of the following features. Superimposing a second linear motion includes linearly moving the transition arm during rotational movement of the rotating member. Superimposing a second linear motion includes angularly moving the transition arm during rotational movement of the rotating member.

The first linear motion and the second linear motion produce a combined linear motion of the piston that results in a shaped piston waveform. The method further includes changing a stroke of the piston to a new stroke; and changing the second linear motion to produce a new combined linear motion of the piston that that results in the shaped piston waveform. Changing a stroke of the piston to a new stroke includes changing an angle between the transition arm and a rotation axis of the rotating member.

The details of one or more implementations are set forth in the accompanying drawings and the description below. Other features, objects, and advantages will be apparent from the description and drawings, and from the claims.

DESCRIPTION OF DRAWINGS

FIGS. 4A-9A are graphs showing exemplary cam profiles for the cam of the hydraulic pump and the corresponding piston positions for different piston strokes.

FIGS. 4B-9B are graphs showing the normalized piston velocities and resulting flow velocity as a function of crankshaft rotation for the corresponding cam profiles in FIGS. 4A-9A.

DETAILED DESCRIPTION

Figure 1A:
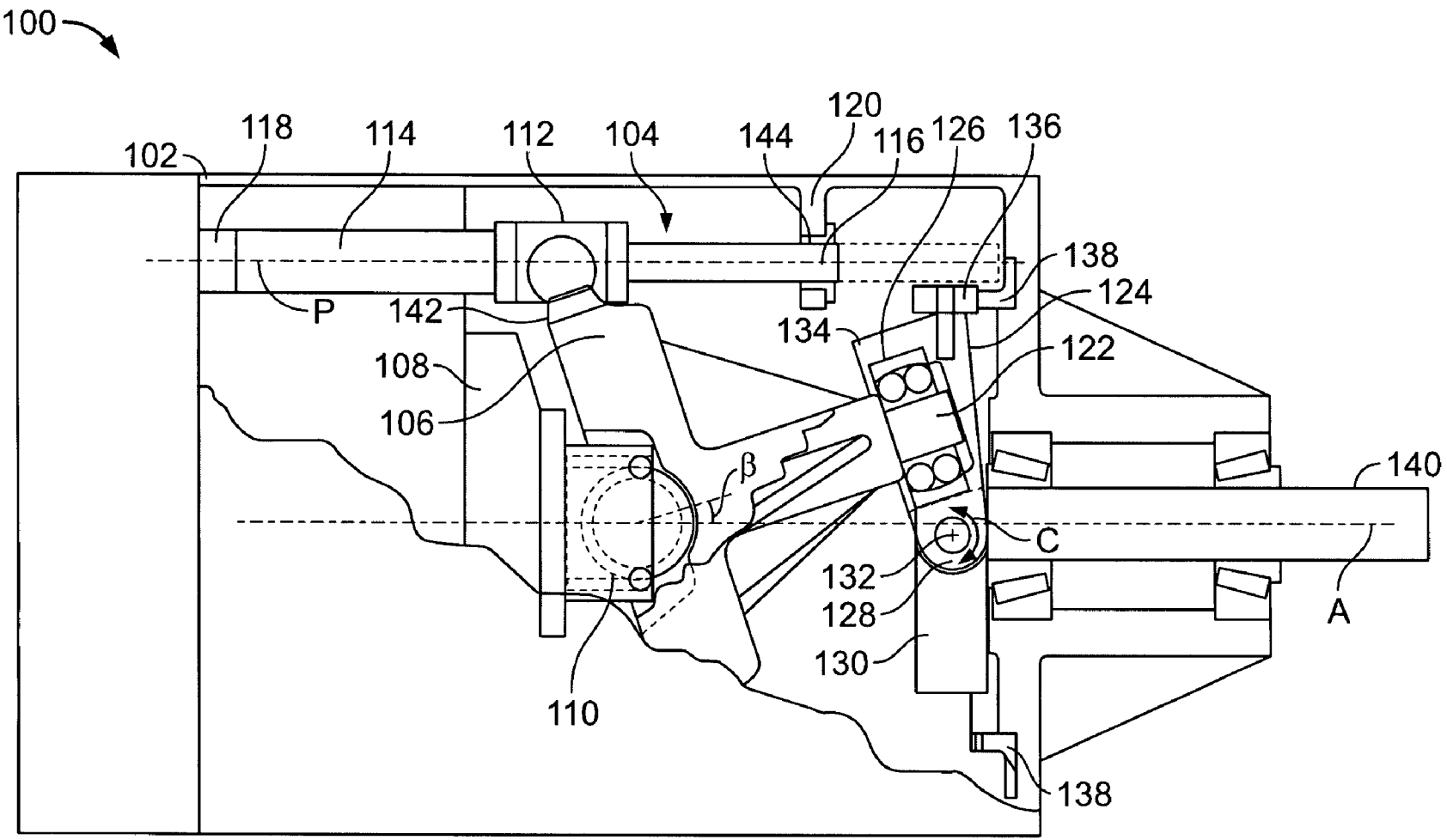
FIGS. 1A and 1B are side and frontal views, respectively, of a hydraulic pump.
Figure 1B:
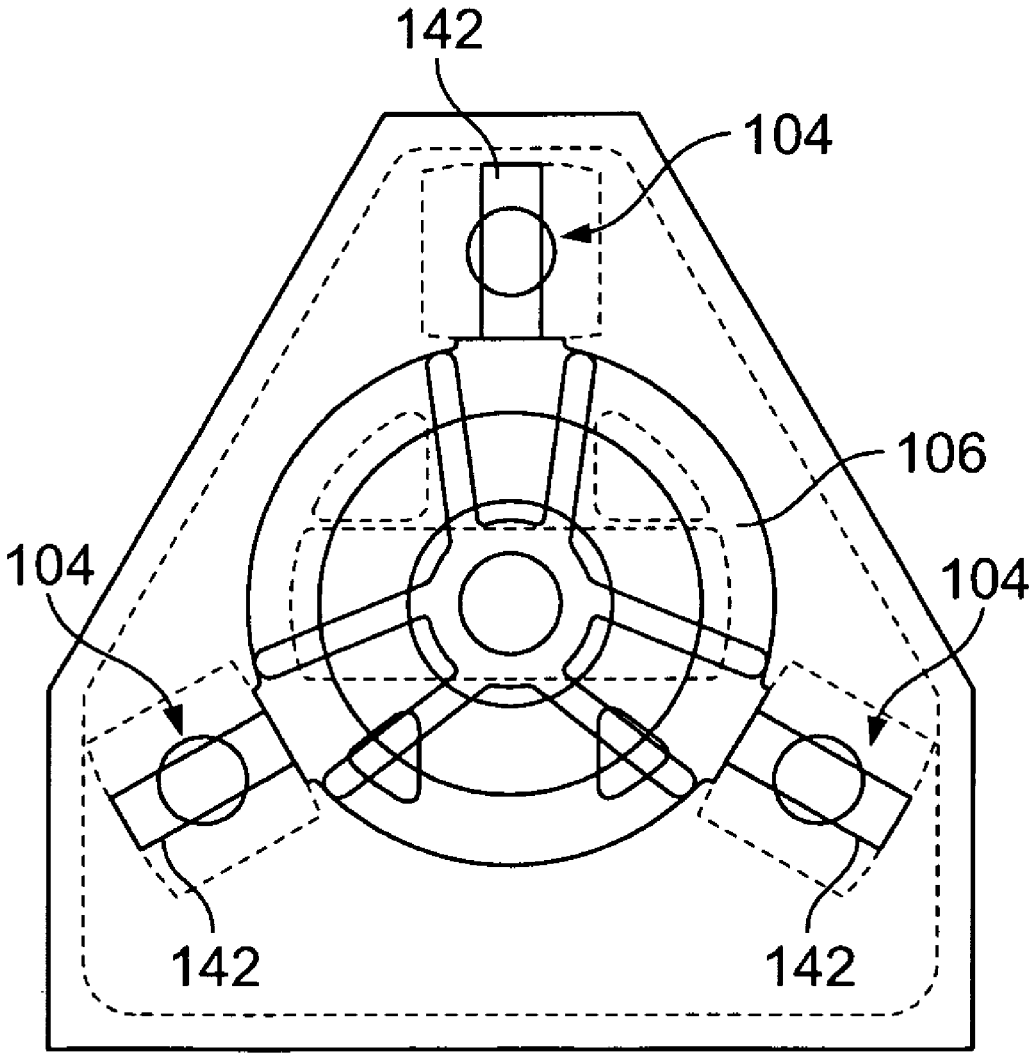
Figure 1C:
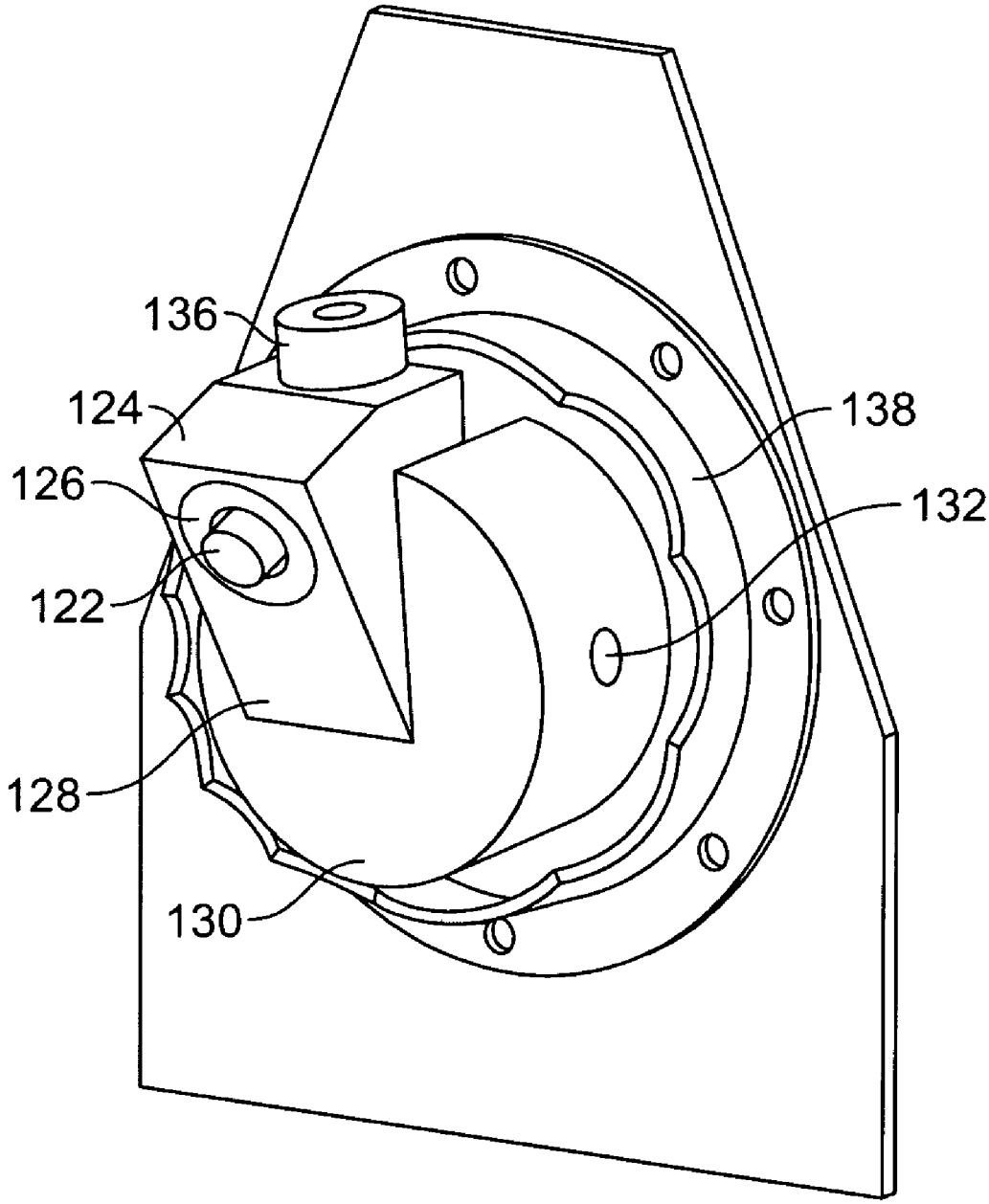
FIG. 1C is a perspective view of the flywheel, cam, cam follower, and pivot member of the hydraulic pump.

Referring to FIGS. 1A, 1B, and 1C, a hydraulic pump assembly 100 includes a housing 102 that houses, e.g. three, piston assemblies 104, which are mounted circumferentially around a transition arm 106 at 120° intervals. Transition arm 106 is mounted to a support 108 by a, e.g., constant-velocity, universal joint (U-joint) 110 that is capable of linear displacement. That is, U-joint 110 allows transition arm 106 to be linearly displaced along assembly axis A. An example of a suitable U-joint is a ball spline, otherwise known as a disc-joint, Rzeppa constant velocity U-joint. Another example is a double-offset Rzeppa joint (which is a Rzeppa constant velocity joint that is modified by making the grooves in the inner race longer such that the bearing cage can slide in and out). Hydraulic pump assembly 100 includes a piston waveform shaping mechanism (which includes U-joint 110 capable of linear displacement) that shapes the velocity and position waveforms of the reciprocating pistons 114 to reduce ripple in a pumped fluid.

Transition arm 106 includes drive pins 142 coupled to piston assemblies 104 via piston joint assemblies 112, such as, e.g., one of the piston joint assemblies described in FIGS. 23-23A in PCT Application WO 03/100231, filed May 27, 2003. Piston assemblies 104 include single ended pistons having a piston 114 on one end and a guide rod 116 on the other end. Pistons 114 are received in cylinders 118 formed in housing 102. Guide rods 116 are received in a sleeve-bearing 144 held by a flange 120 extending from housing 102.

Transition arm 106 also includes a nose pin 122 that couples a pivot member 124 to transition arm 106 via a self-aligning nose pin bearing 126 such that transition arm 106 is at a fixed angle β with respect to assembly axis A. Nose pin 122 is axially fixed within pivot member 124. Pivot member 124 has an end 128 mounted to a rotating member, e.g., a flywheel 130, by a pivot pin 132 such that pivot member 124 can rotate about pivot pin 132 (arrow C). Attached to an opposite end 134 of pivot member 124 is a cam follower 136, e.g., a roller-type cam follower. Referring particularly to FIG. 1C, cam follower 136 mates with a stationary cam 138, e.g., a face-cam. Cam 138 is a cylindrical ring mounted to housing 102 co-axial with flywheel 130 such that 130 rotates relative to stationary cam 138.

Flywheel 130 is coupled to a crankshaft 140 such that rotation of crankshaft 140 causes rotation of flywheel 130. Rotation of flywheel 130 results in nose pin 122 moving in a generally circular fashion about assembly axis A. The circular motion of nose pin 122 about assembly axis A is translated by transition arm 106 into a linear motion of piston assemblies 104 along piston axis P. Thus, transition arm 106 translates rotation of flywheel 130 into a linear motion of piston assemblies 104 along piston axis P.

Also, as flywheel 130 rotates, cam follower 136 follows a profile machined, e.g., into the face of cam 138. The profile varies along the direction of assembly axis A and cam follower 136 travels along the profile such that, as the flywheel 130 rotates, pivot member 124 is pivoted about pin 132. Pivoting of pivot member 124 exerts a force on transition arm 106, which, because U-joint 110 is capable of linear displacement, results in U-joint 110 and transition arm 106 being moved along axis A as the flywheel 130 rotates. This movement of transition arm 106 imparts a linear motion to piston assemblies 104 (and, hence, pistons 114) along piston axis P that is superimposed on the stroke of the pistons that results from the generally circular motion of nose pin 122 about assembly axis A.

Figure 2:
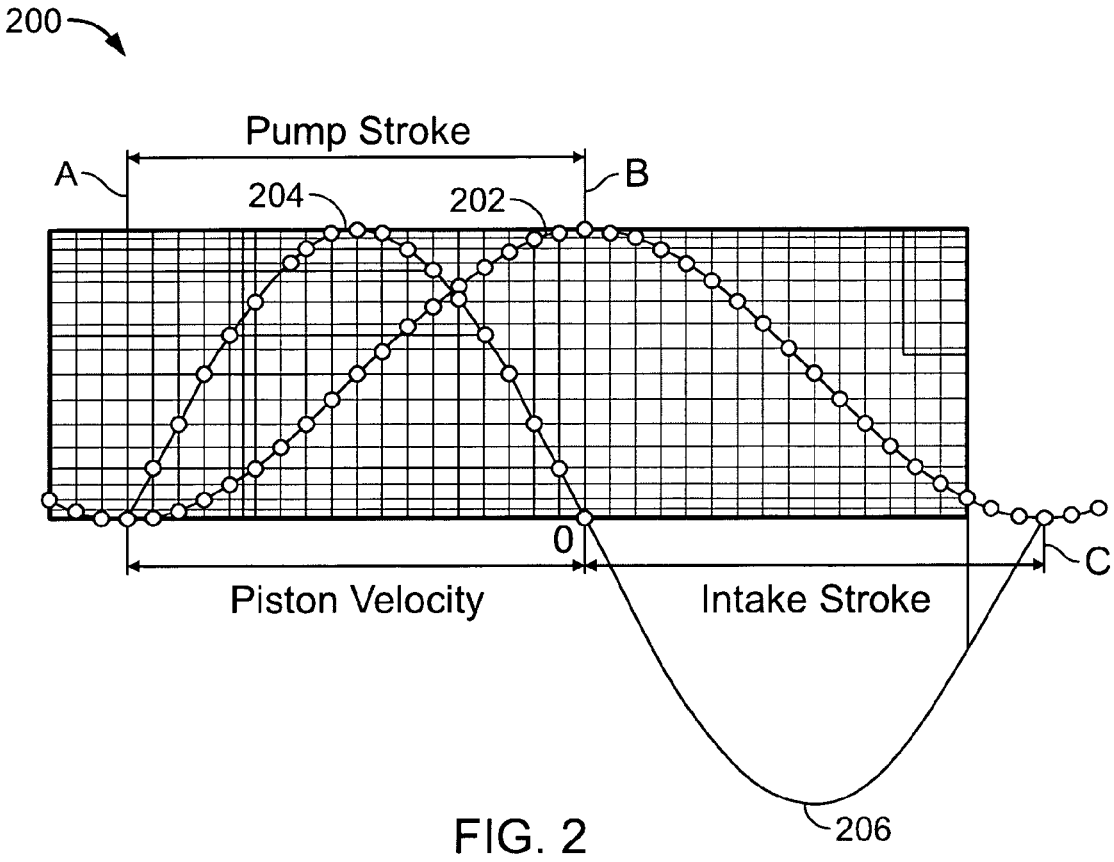
FIG. 2 is a graph showing the velocity and position of one of the hydraulic pump's pistons.

Referring to FIG. 2, the motion of piston assemblies 104 resulting from the generally circular motion of nose pin 122 about assembly axis A is linear in space (along piston axis P, as described above) and sinusoidal in time (i.e., simple harmonic motion). Graph 200 shows the position and velocity waveforms (the piston waveforms) of one of the piston assemblies 104 resulting from the generally circular motion of nose pin 122 about assembly axis A. Line 202 shows the harmonic motion of the piston position. The portion of line 202 between lines A and B shows the pump stroke of piston assembly 104. Line 204 shows the corresponding velocity (which corresponds to the slope of line 202) of piston assembly 104 during the pump stroke. The portion of line 202 between lines B and C shows the intake stroke of piston assembly 104. The corresponding velocity curve 206 is similar to line 204, except it is inverted because the velocity of piston assembly 104 during the intake stroke is opposite the velocity during the pump stroke.

Figure 3:
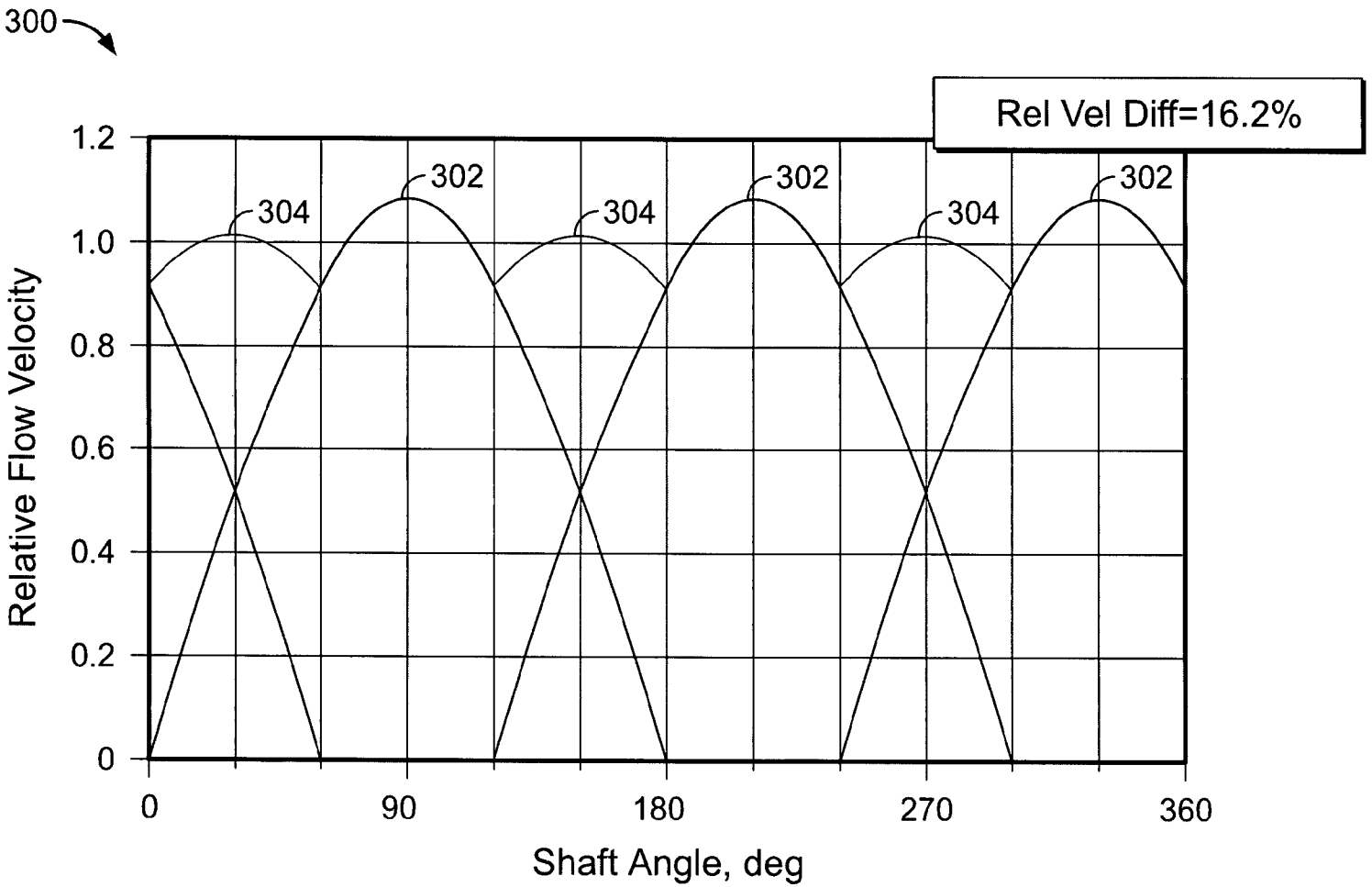
FIG. 3 is a graph illustrating the relative flow velocity of the pumped fluid that results from the combined motion of the piston assemblies of the hydraulic pump, absent the linear motion added by the piston waveform shaping mechanism of the hydraulic pump.

Referring to FIG. 3, the flow velocity of the fluid pumped by a piston assembly 104 is related to the piston assembly's velocity. Graph 300 illustrates the relative flow velocity of the pumped fluid that results from the combined motion of the three piston assemblies 104 caused by the generally circular motion of nose pin 122 about assembly axis A (which, as described above, is caused by the rotation of crankshaft 140). The relative flow velocity has peaks 304 spaced about 120° apart and which extend over 60° of the crankshaft rotation. The relative flow velocity also has overlap peaks 302, which are of greater amplitude than peaks 304 and offset from peaks 304 by 60°. Overlap peaks are also spaced 120° apart and extend over 60° of the crankshaft rotation.

Thus, absent the linear motion imparted to piston assemblies 104 by cam 138 and cam follower 136, the output flow velocity would have a ripple of about 16 or 17 percent, as shown in FIG. 3. To reduce such ripple, the profile of cam 138 is designed such that the additional linear motion imparted to piston assemblies 104 by cam follower 136 following the profile of cam 138 acts to flatten peaks 302 and 304 by appropriately reducing or increasing the velocity of each piston assembly 104.

The appropriate cam profile to achieve a desired shape of the piston or output waveforms can be determined by iteration. For example, the flow velocity of hydraulic pump assembly 100 (with, e.g., a smooth cam profile or, e.g., absent a cam profile) is measured as a function of the crankshaft's angle of rotation. For the angles that the flow velocity is high, the cam profile is adjusted to add a linear motion that reduces the velocity of the pistons in the pump stroke, while, for angles that the flow velocity is low, the cam profile is adjusted to add a linear motion that increases the velocity of the pistons in the pump stroke. After the cam profile is adjusted, the output of the hydraulic pump assembly with the adjusted cam profile is measured as a function of the crankshaft angle. If there is ripple in the output, the cam profile is again adjusted to add a linear motion that reduces the velocity of the pistons in the pump stroke for angles that the flow velocity is high, while, for angles that the flow velocity is low, the cam profile is adjusted to add a linear motion that increases the velocity of the pistons in the pump stroke. This process is repeated until a cam profile that reduces the ripple to the desired amount is obtained. Alternatively, the pistons' motion or velocity is measured as a function of the crankshaft angle, and iteration is used to determine the appropriate cam profile that produces the desired shape of the pistons' waveforms (i.e., the desired shape of the pistons' position and velocity waveforms).

FIGS. 4A-9A show exemplary cam profiles and the corresponding piston positions for different angles β (the angle between the drive arm 146 and assembly axis A), which determines the stroke of pistons 104. The cam profile that flattens the velocity peaks changes when the angle β (and hence the stroke) is changed. FIGS. 4A, 5A, 6A, 7A, 8A, and 9A illustrate normalized cam profiles and piston positions as a function of crankshaft rotation for β equal to 5, 10, 15, 20, 25, and 30 degrees respectively. Lines 402, 502, 602, 702, 802, and 902 show the cam profiles. Lines 404, 504, 604, 704, 804, and 904 show the positions of piston 1. Lines 406, 506, 606, 706, 806, and 906 show the positions of piston 2. Lines 408, 508, 608, 708, 808, and 908 show the positions of piston 3.

FIGS. 4B-9B illustrate the normalized piston velocities and resulting flow velocity as a function of crankshaft rotation for β equal to 5, 10, 15, 20, 25, and 30 degrees respectively. Lines 412, 512, 612, 712, 812, and 912 show the velocity of piston 1. Line 414, 514, 614, 714, 814, and 914 show the velocity of piston 2. Line 416, 516, 616, 716, 816, and 916 show the velocity of piston 3. Lines 410, 510, 610, 710, 810, and 910 show the resulting flow velocity.

Figure 4A:
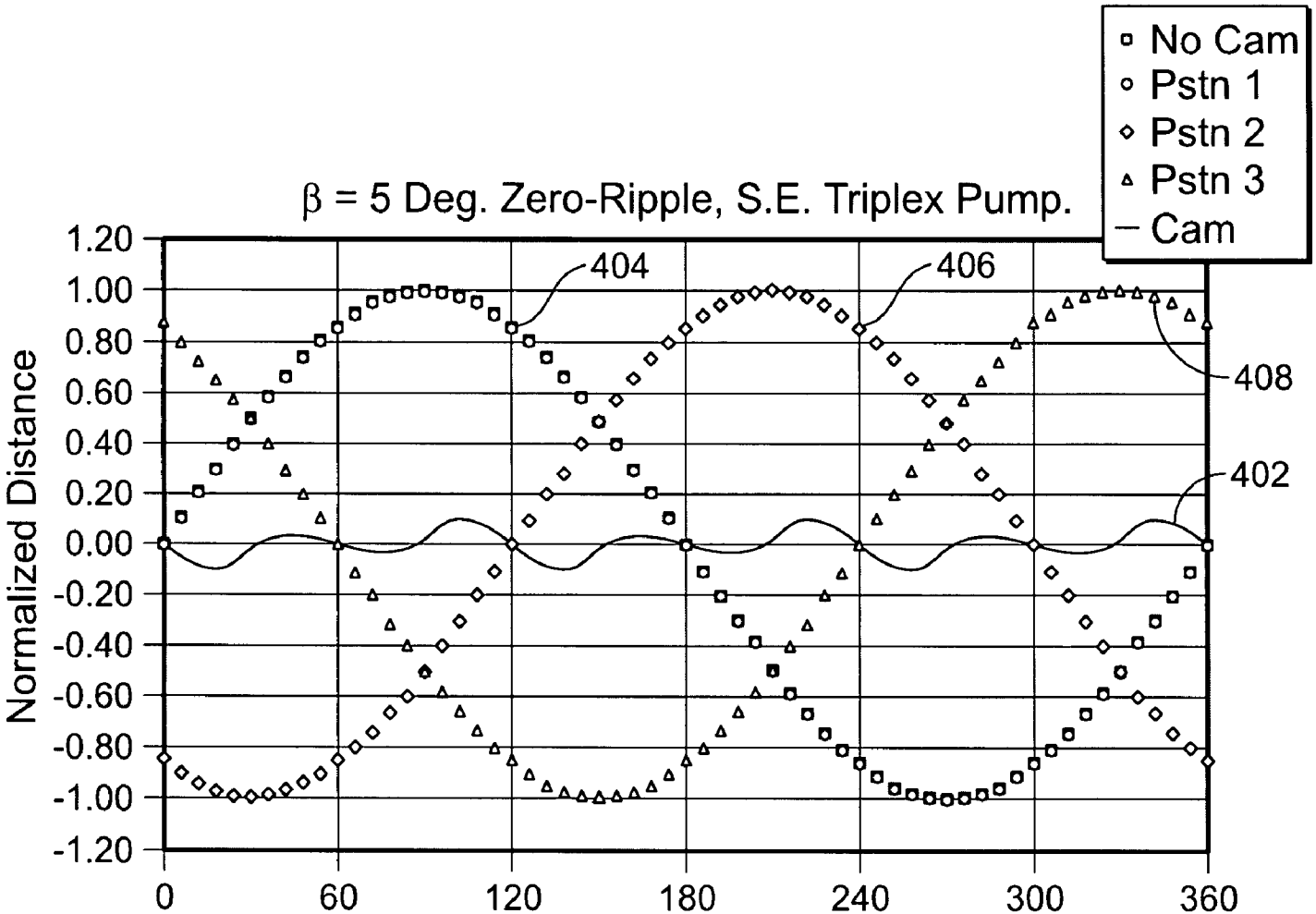
Figure 4B:
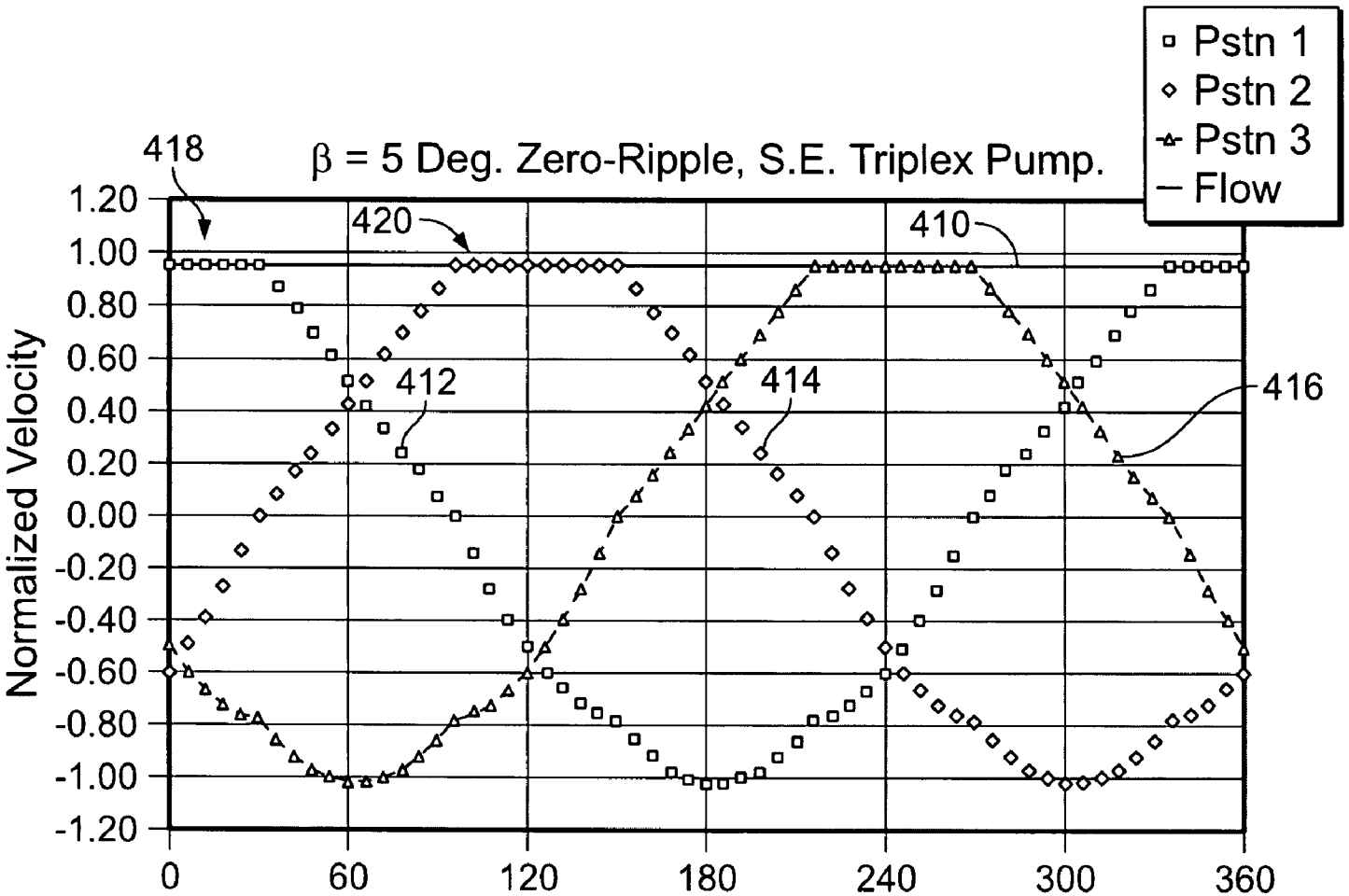
Figure 5A:
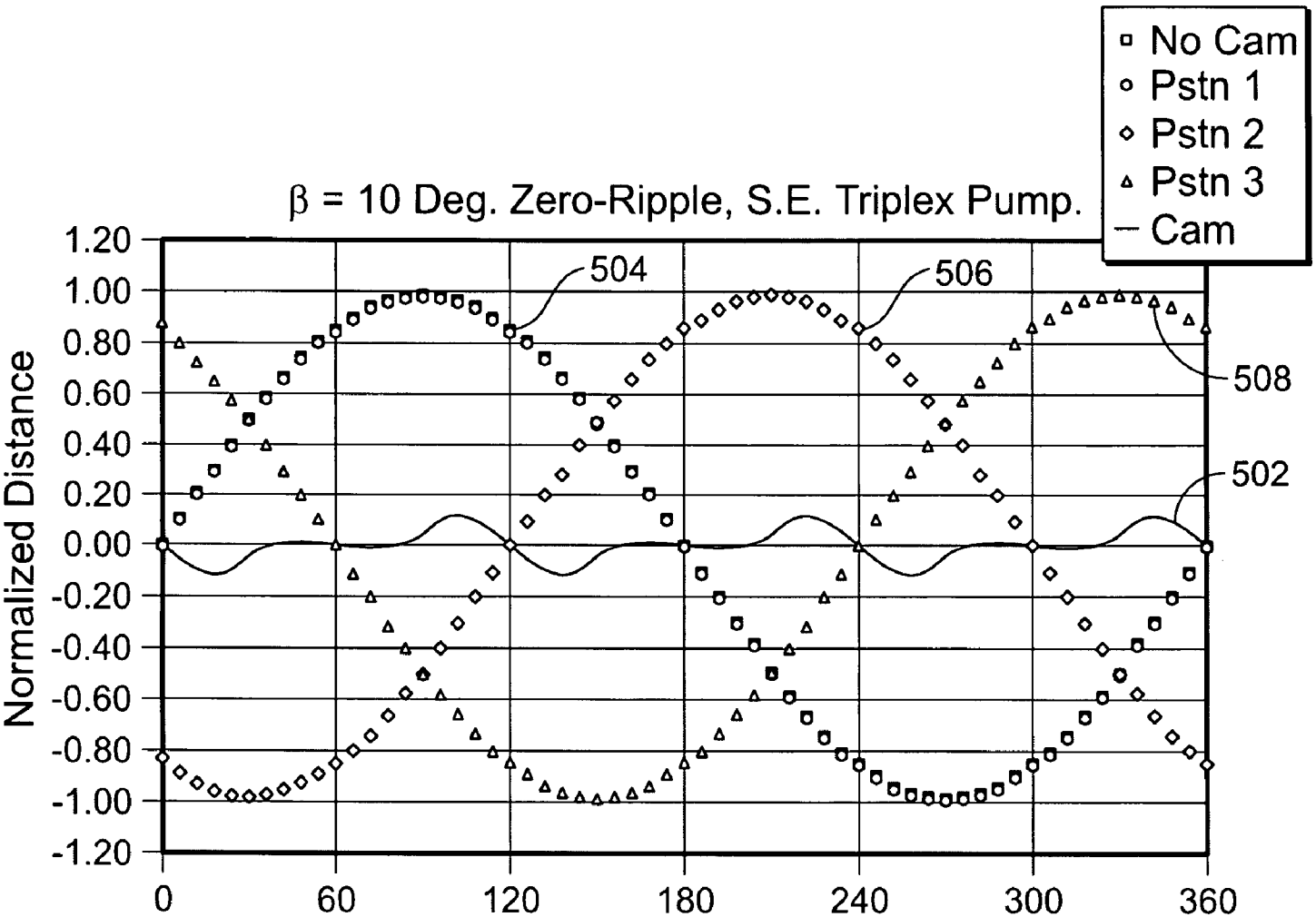
Figure 5B:
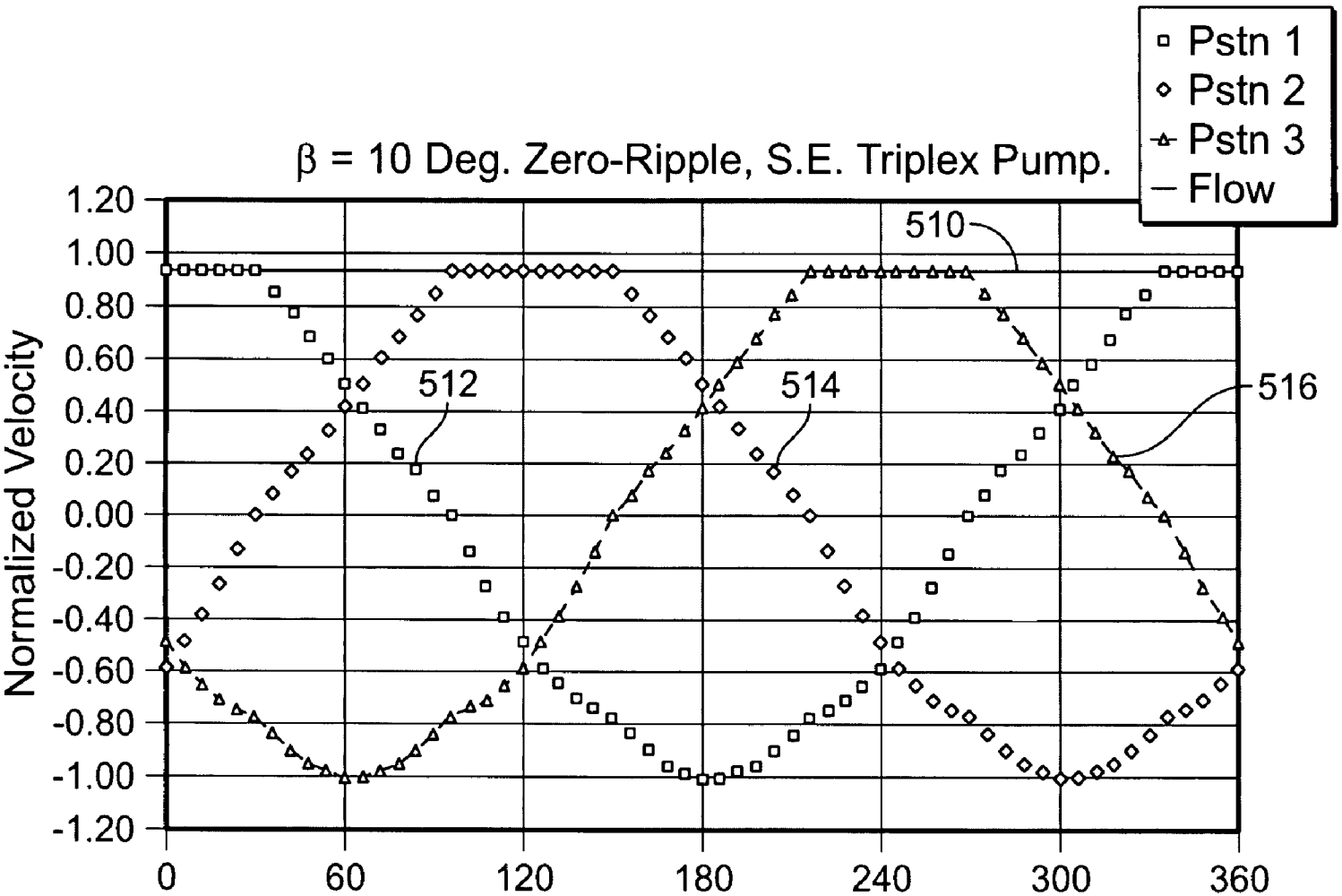
Figure 6A:
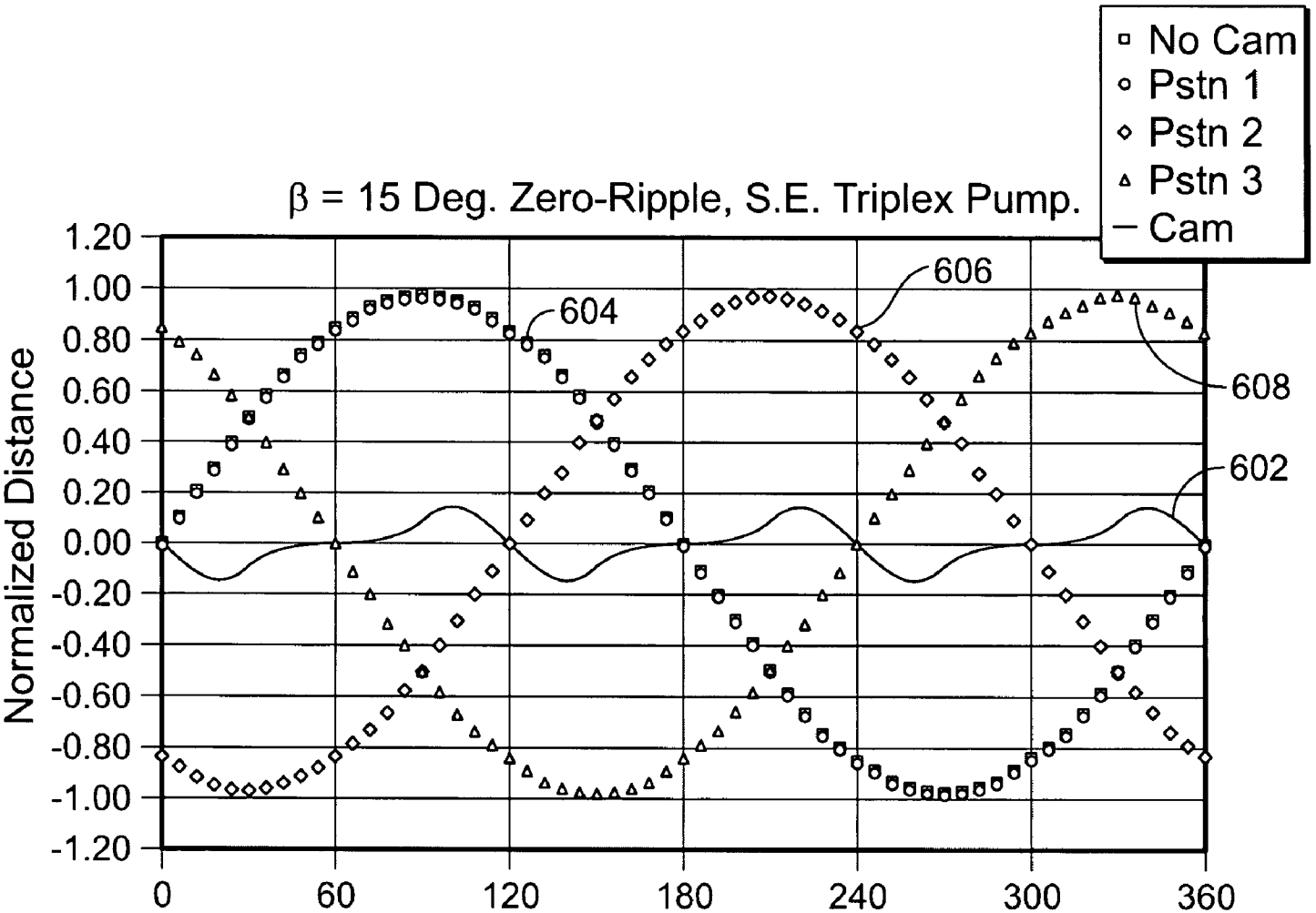
Figure 6B:
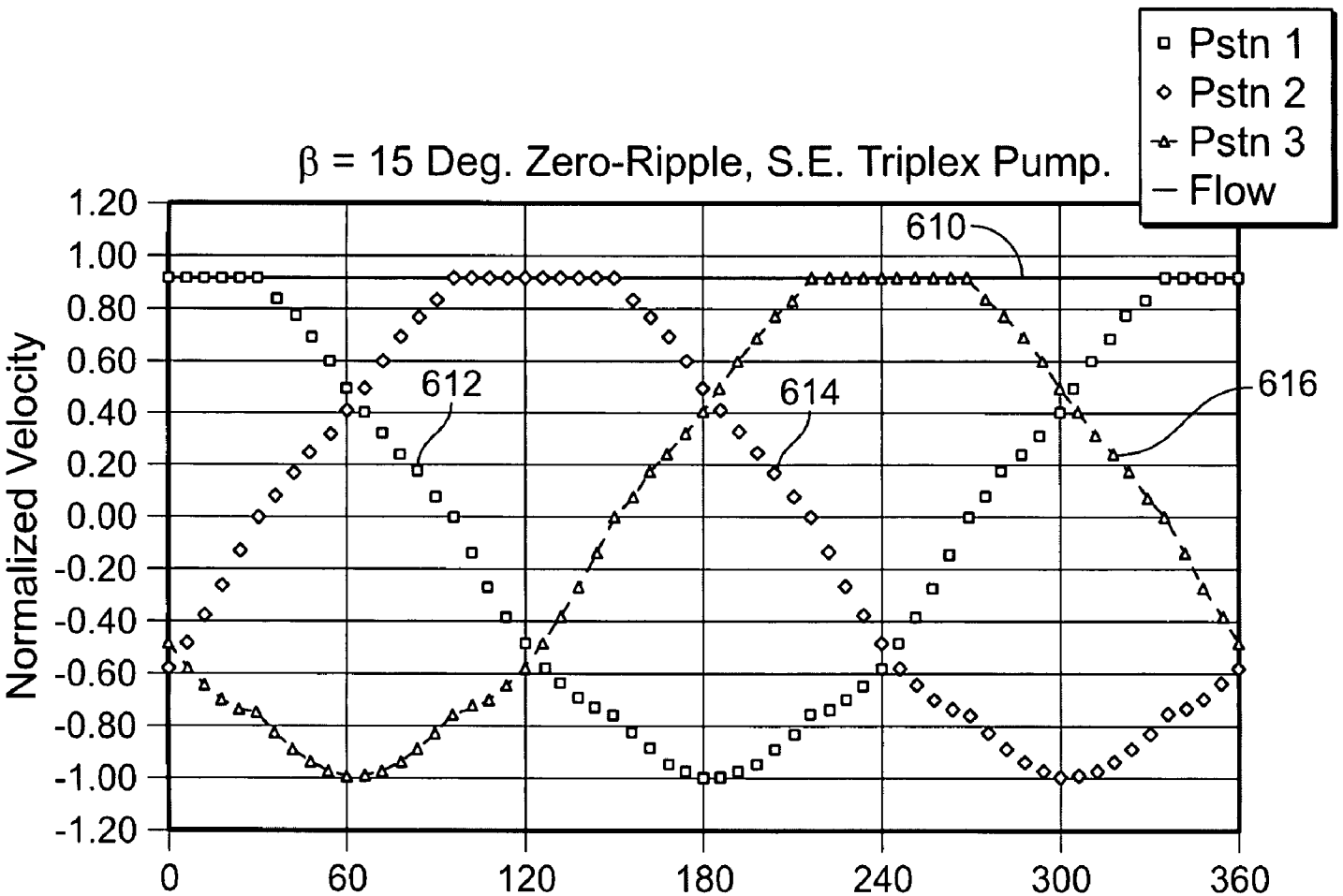
Figure 7A:
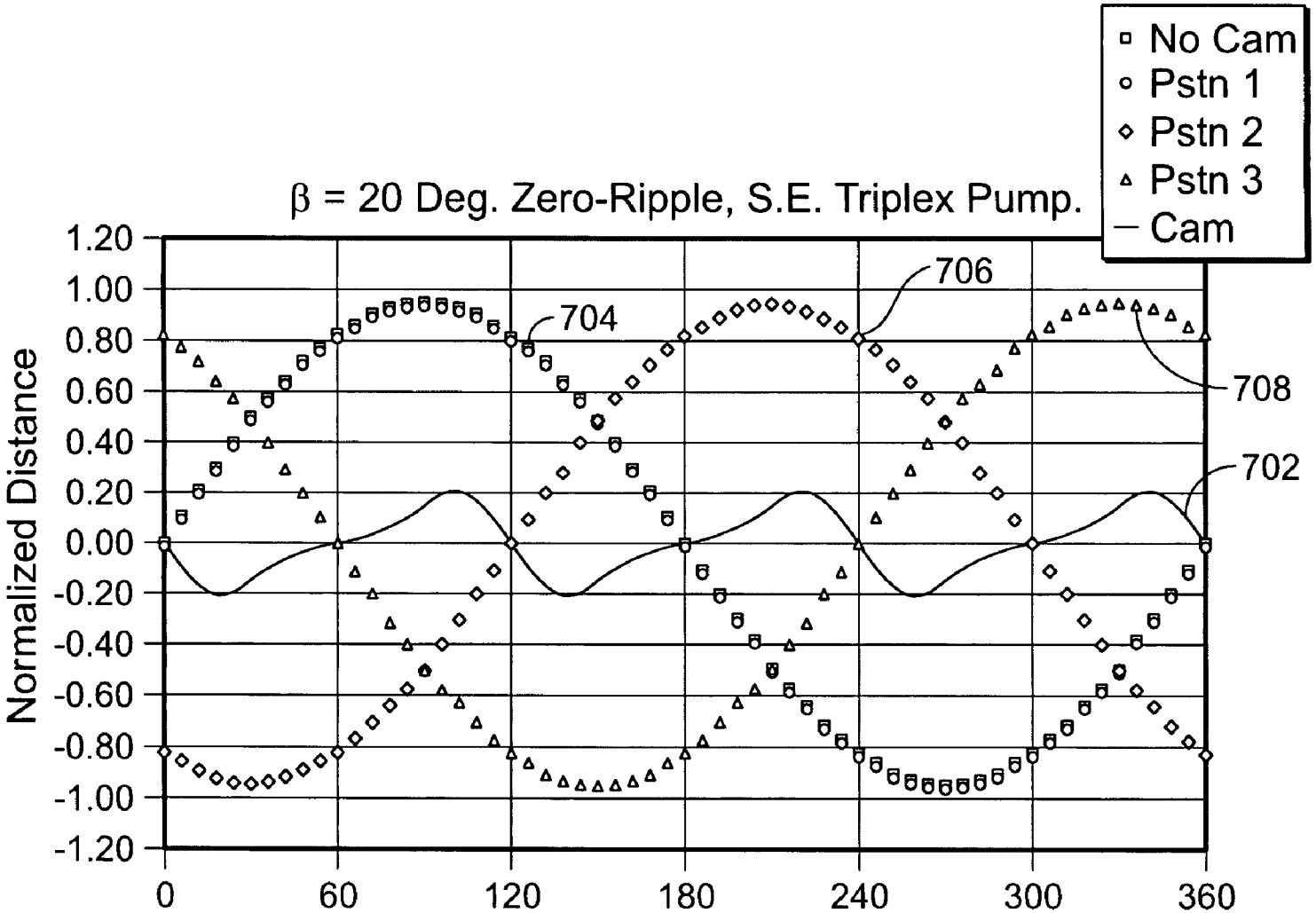
Figure 7B:
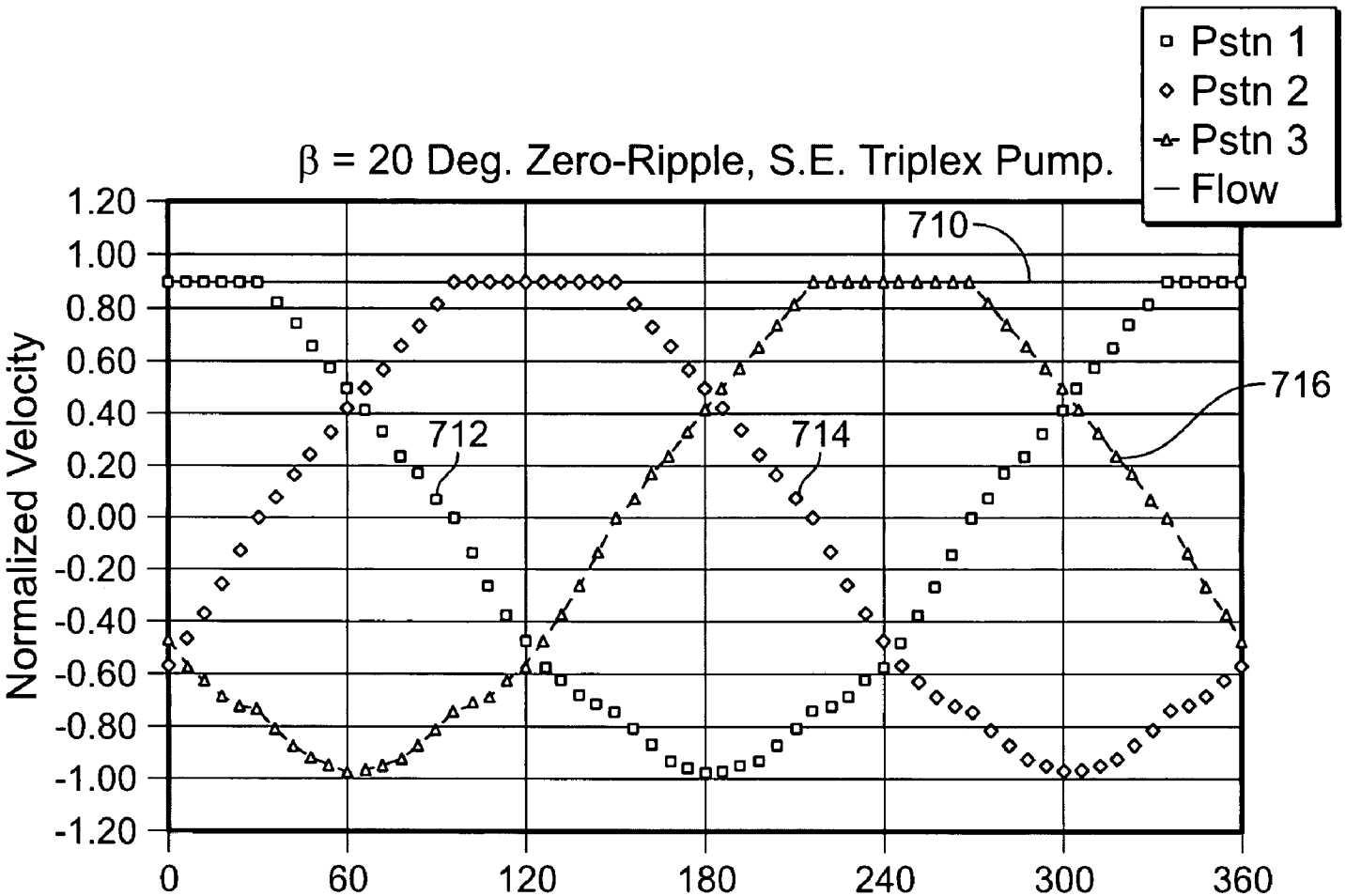
Figure 8A:
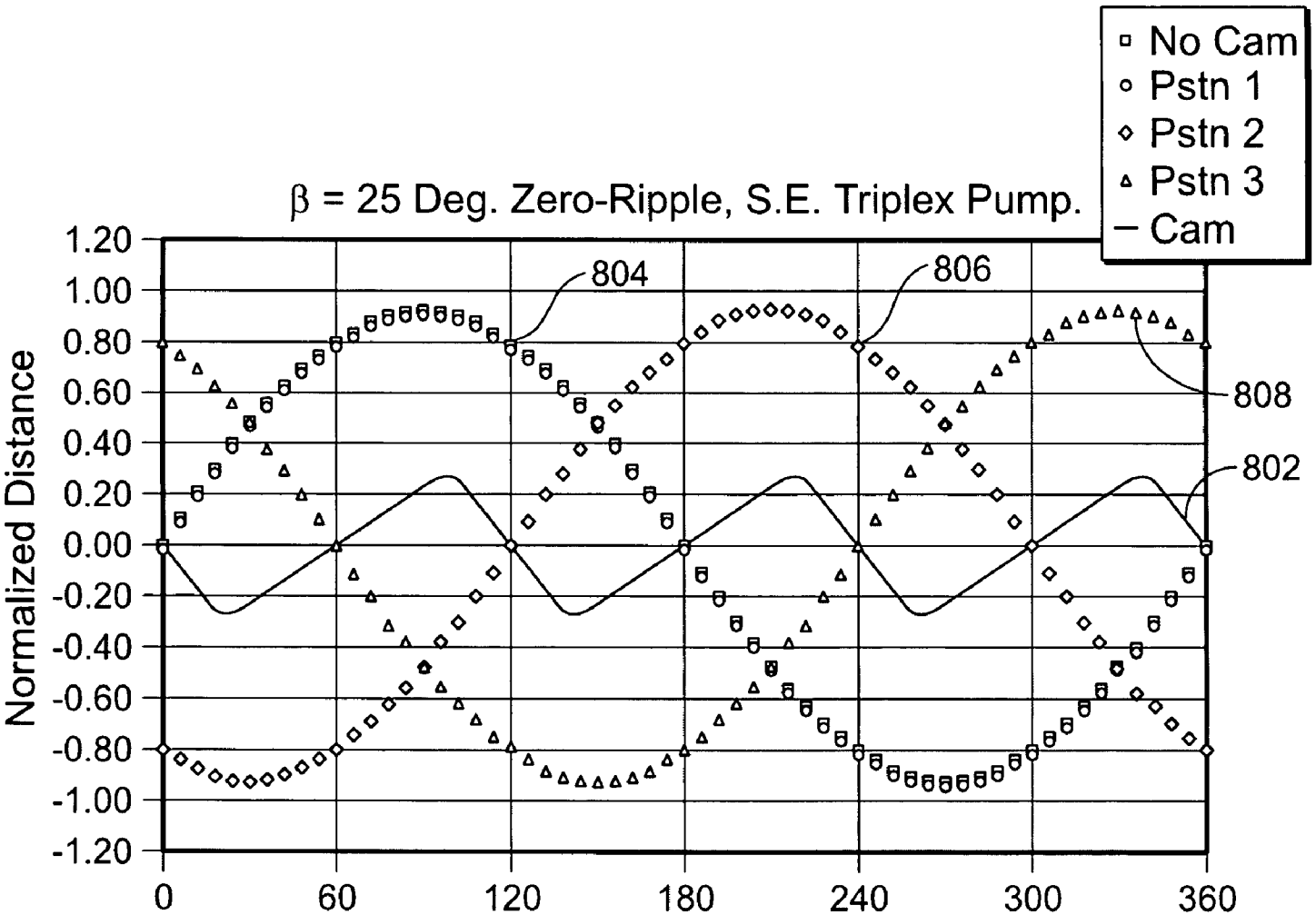
Figure 8B:
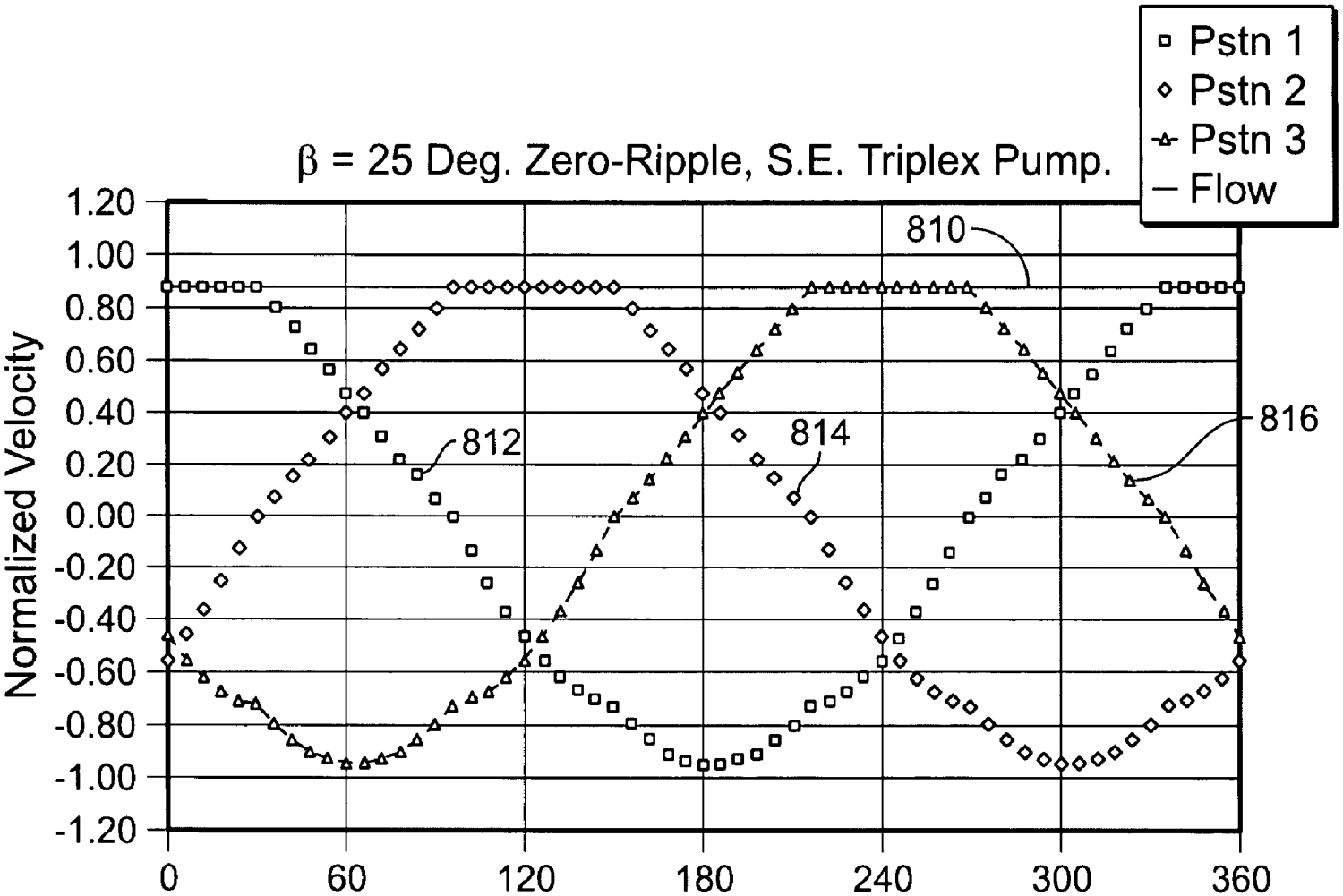
Figure 9A:
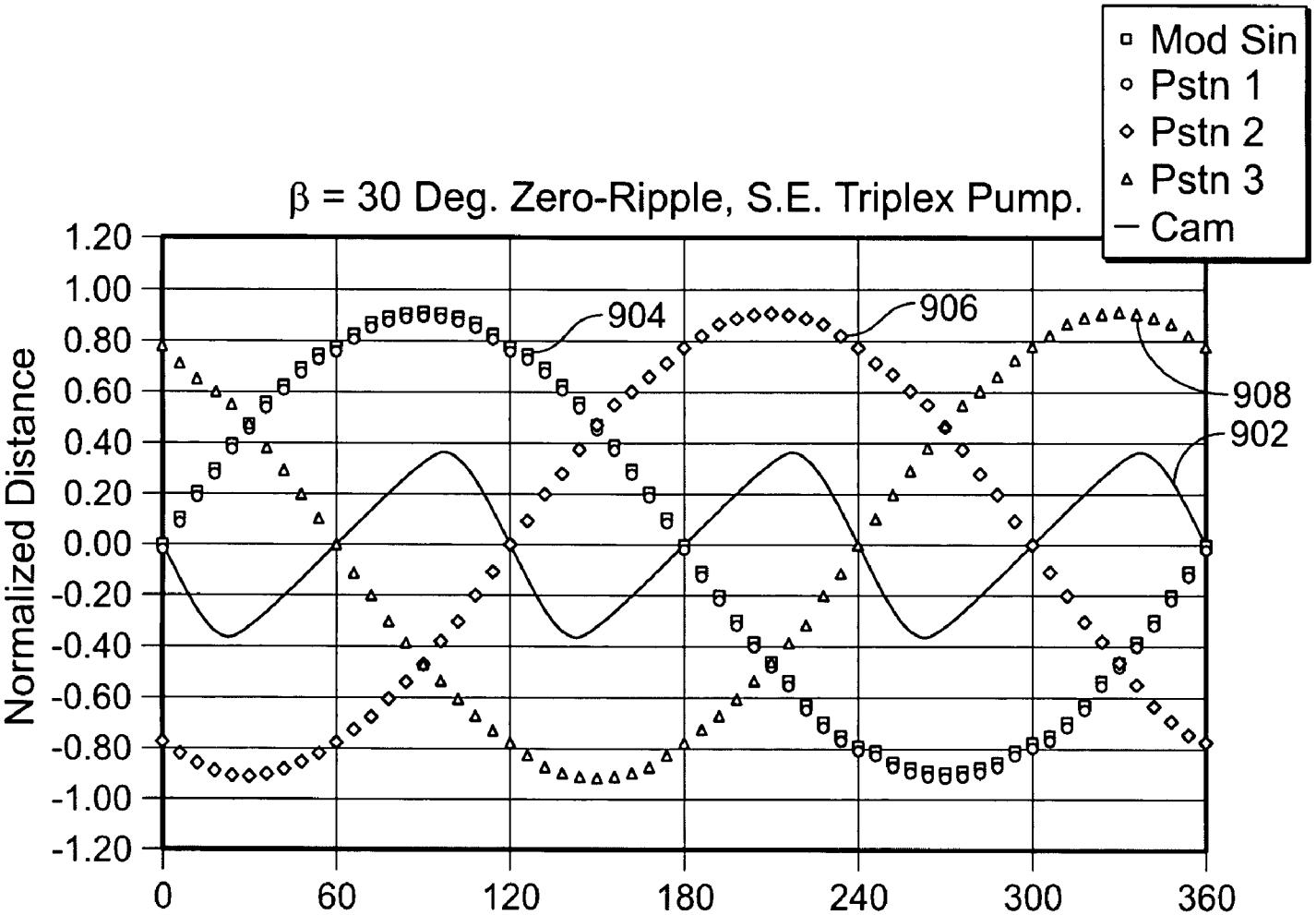
Figure 9B:
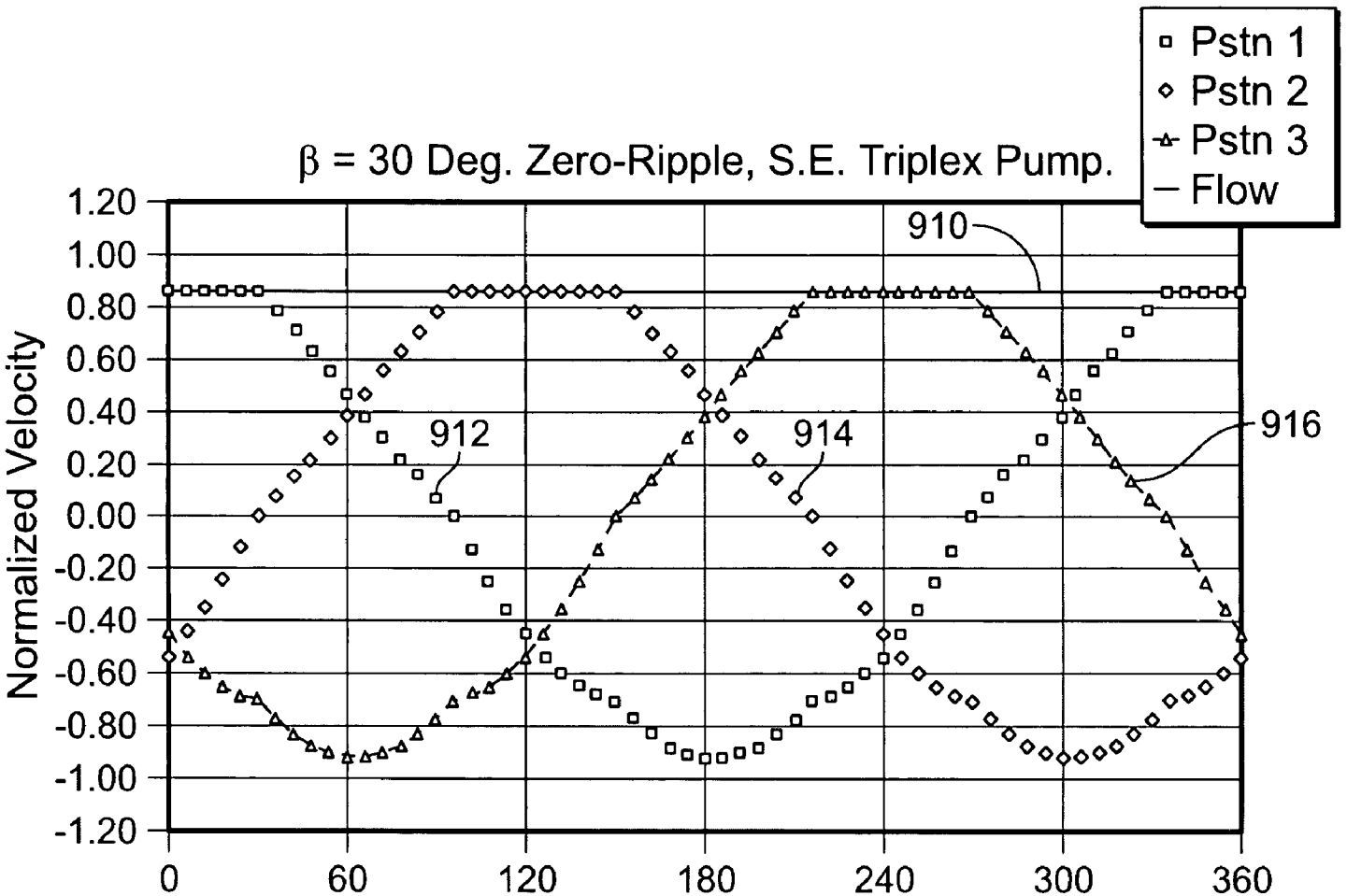

As can be seen, the peaks of each piston's velocity are flattened to produce a constant piston velocity over the peak. Thus, at the peaks, the flow velocity is constant. In between the peaks, the velocity of the piston previously at the peak is decreasing at substantially the same rate that the velocity of the next piston is increasing. Consequently, the flow velocity in between the peaks is also constant and substantially equal to the flow velocity over the peaks. For example, piston 1 (line 412) has a first peak 418 as shown in FIG. 4B. As the velocity of piston 1 decreases from peak 418, the velocity of piston 2 (line 414) is increasing at substantially the same rate towards a peak 420. As a result, the net flow velocity between peaks 418 and 420 is constant and substantially equal to the flow velocity at the first peak.

Output ripple in hydraulic pumps causes many problems in the field, for example, vibration, resonance in supporting piping, need to filter, certain rpm's that must be avoided owing to resonance, and the use of large accumulators to suppress the ripple, essentially cushioning the pressure variations in a large air tank. With a reduced or eliminated ripple, the above problems do not arise, and one is free to operate over a large range of speed with no vibration, no excitation of resonance, and no need for accumulators. Typical hydraulic pumps attempt to reduce ripple through the use of additional pistons. Assembly 100 can provide reduced ripple equivalent to typical 11 piston systems, but with three pistons.

Figure 10:
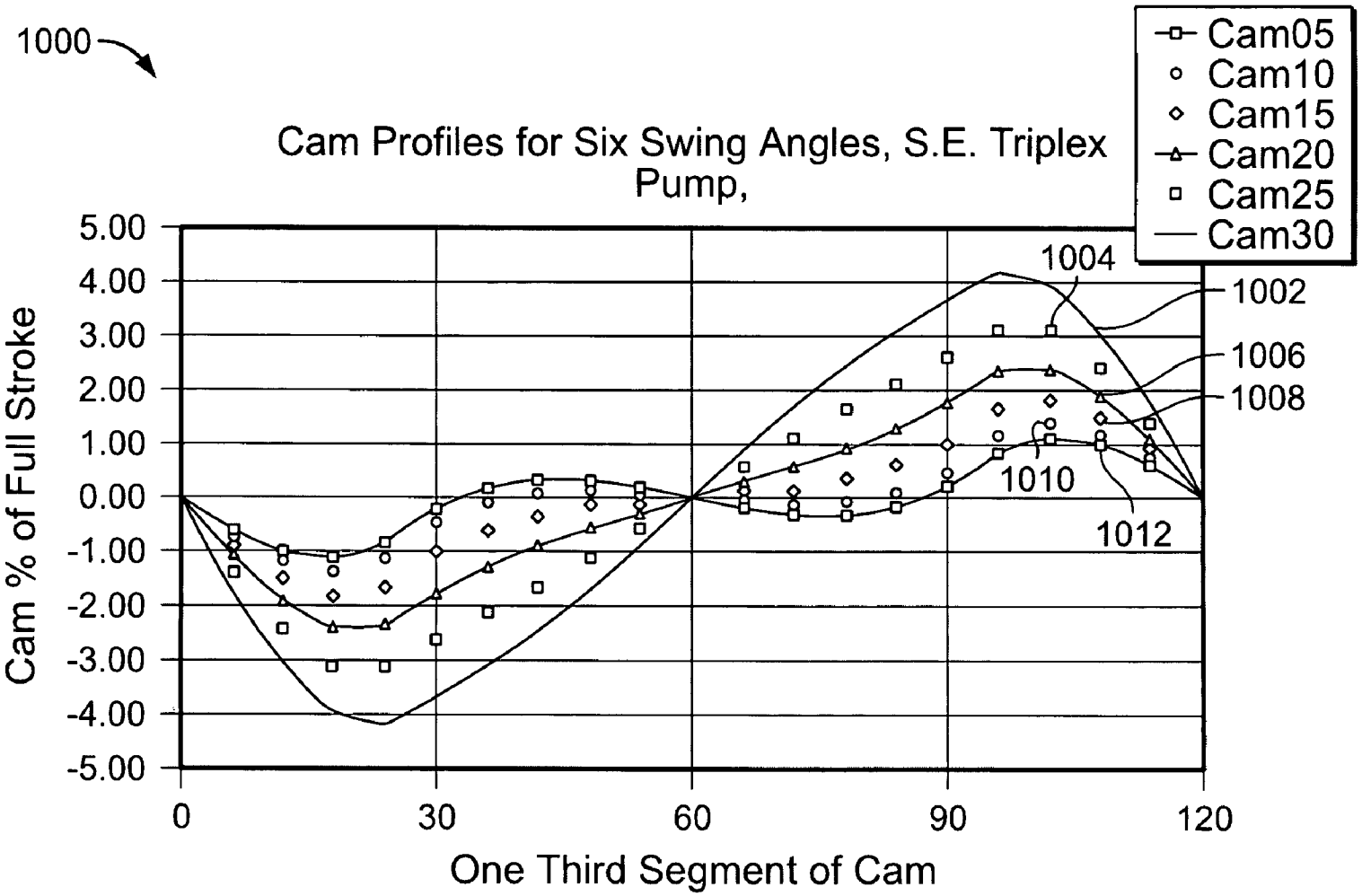
FIG. 10 is a graph showing the cam profiles for the cam of the hydraulic pump as a percentage of stroke for different piston strokes.

Referring to FIG. 10, graph 1000 shows the cam profile, as a percentage of the full stroke, over a one-third segment of the cam, e.g., from 0 to 120 degrees. Six profiles are shown, where each profile corresponds to a different value of the angle β. Lines 1002, 1004, 1006, 1008, 1010, and 1012 respectively show the cam profile for angle β equal to 30, 25, 20, 15, 10, and 5. For example, referring to line 1012, for a 2 inch stroke and β equal to 5 degrees, the cam profile varies from a centerline of the profile by 0.02 inches at 15 degrees (i.e., at 15 degrees, the magnitude of the cam profile is 1 percent of the full stroke).

Other implementations use other techniques and mechanisms to impart an additional linear motion to pistons 114 to shape the piston waveforms. For example, in one implementation, cam 138 and cam follower 136 are not used. Rather, a positioning mechanism is attached to U-joint 110 on the side opposite crankshaft 140 and transition arm 106 is coupled to a pivot member that does not include cam follower 136. The position mechanism moves U-joint 110 along assembly axis A under computer control. The computer includes a computer program that simulates the cam profile and moves U-joint 110 along assembly axis A based on the rotation angle of crankshaft 140 or flywheel 130 to achieve the desired piston waveforms.

In other implementations, such a computer-controlled position mechanism is used in conjunction with a variable stroke mechanism, such as one of the mechanisms described in, e.g., FIGS. 54 and 57 of PCT Application WO 03/100231, supra. The appropriate cam profile depends on the angle β, and thus the stroke, as described above. When used with a variable stroke mechanism, the computer program is designed to determine the correct cam profile for a given value of the stroke or is designed to access the correct cam profile for a given stroke value from a set of stored cam profiles. When a particular stroke is set by the variable stroke mechanism, the computer program then determines or accesses the correct cam profile to obtain the desired piston waveforms and controls the position mechanism accordingly to move the U-joint 110 along assembly axis A.

Figure 11A:
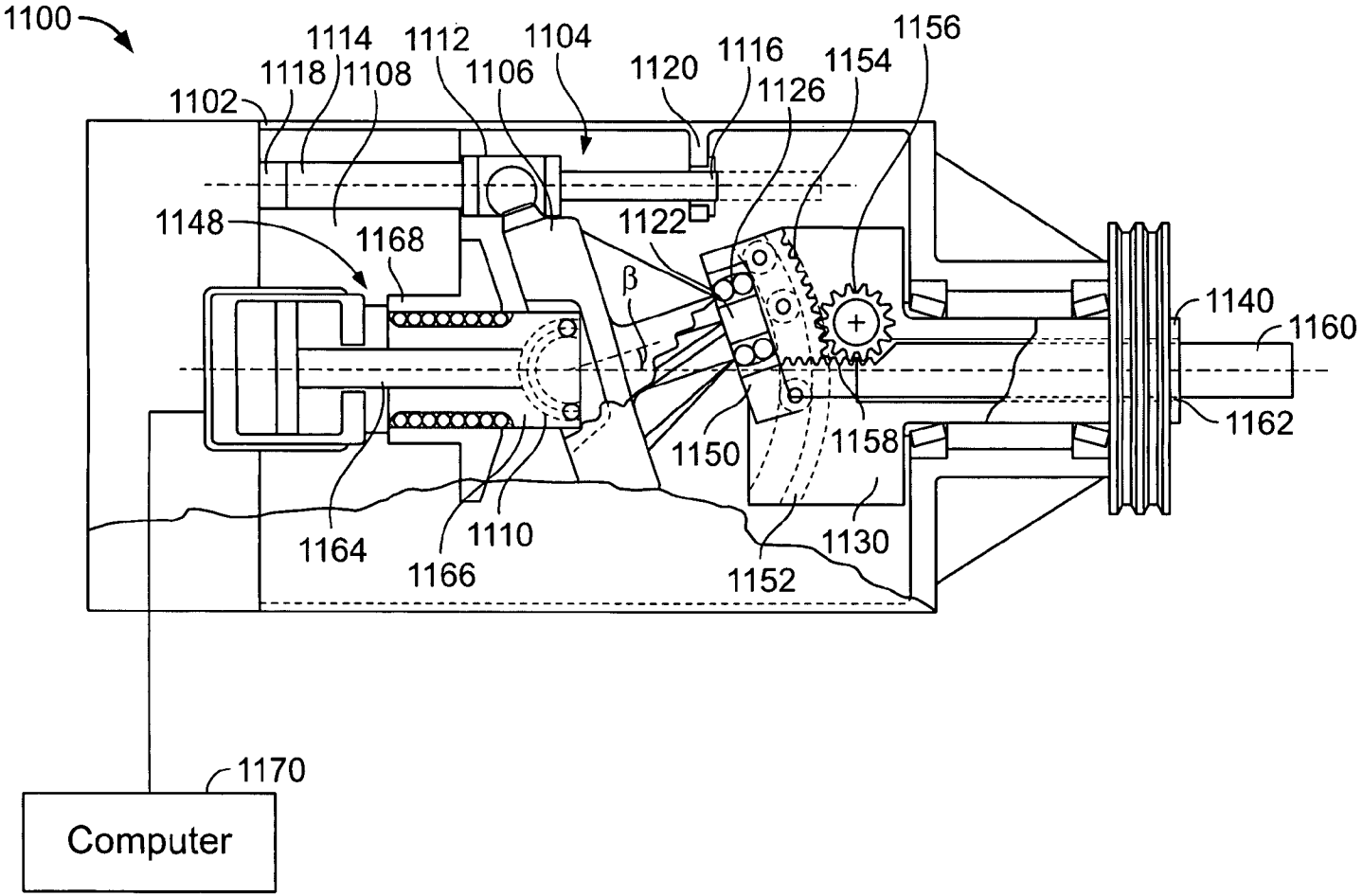
FIGS. 11A and 11B show side and frontal views, respectively, of an alternative hydraulic pump.
Figure 11B:
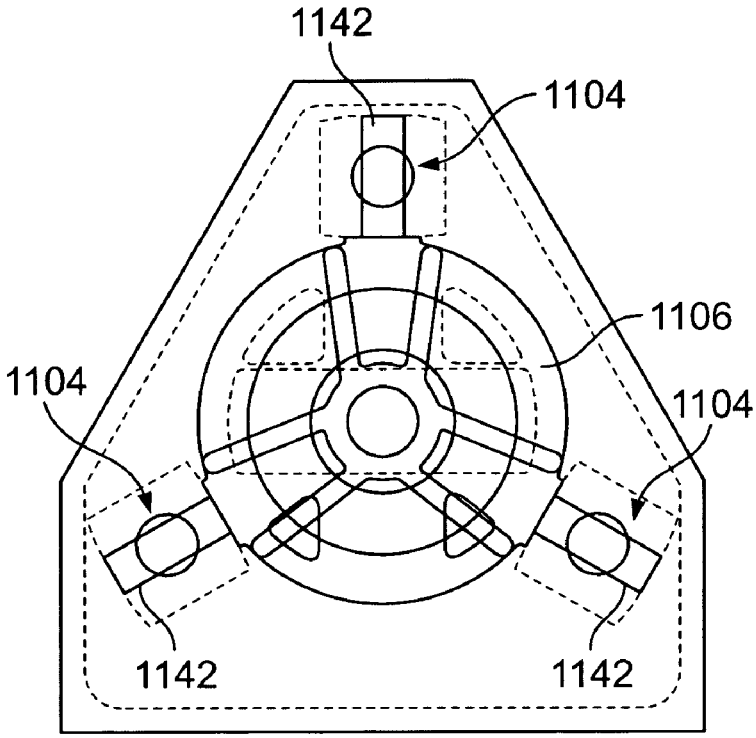

Referring to FIGS. 11A and 11B, a variable stroke hydraulic pump 1100 incorporates such a computer-controlled position mechanism. Hydraulic pump assembly 1100 includes a housing 1102 that houses, e.g., three piston assemblies 1104, which are mounted circumferentially around a transition arm 1106. Illustrated are three piston assemblies 1104 mounted circumferentially about transition arm 1106 at 120° intervals. Transition arm 1106 is mounted to a position mechanism, e.g., a push/pull cylinder 1148, by, e.g., a constant-velocity, universal joint (U-joint) 1110. Push/pull cylinder 1148 is mounted to support 1108 and includes a rod 1164.

Rod 1164 is connected to a slider 1166, to which U-joint 1110 is attached. Slider 1166 passes through a linear ball bushing 1168. Linear ball bushing 1168 allows slider 1166 to move linearly along assembly axis A, but prevents rotational motion of slider about assembly axis A.

Push/pull cylinder 1148 uses, e.g., hydraulics and/or spring actuation to linearly move rod 1164, and consequently slider 1166 and U-joint 111, along assembly axis A. Push/pull cylinder 1148 is connected to a computer, which controls the actuation of push/pull cylinder 1148 so as to control the linear movement of rod 1164. In one implementation, push/pull cylinder is equipped with position feedback so that computer 1170 is able to precisely control the position of rod 1164 and, hence, U-joint 1110.

Transition arm 1106 also includes a nose pin 1122 coupled to a bearing block 1150 via a self-aligning nose pin bearing 1126 such that transition arm 1106 is at an angle β with respect to assembly axis A. The value of the angle β determines the stroke of piston assemblies 1104. To adjust the angle β, and thus vary the stroke of piston assemblies 1104, bearing block 1150 is housed in an arced channel 1152 defined by a rotating member, e.g., a flywheel 1130. Bearing block 1150 includes a gear-toothed surface 1154 that mates with a pinion gear 1156 housed within flywheel 1130. Pinion gear 1156 also mates with a rack portion 1158 formed at the end of a control rod 1160, which passes through a central bore in a crankshaft 1140. A linear ball bushing 1162 is positioned between crankshaft 1140 and control rod 1160 such that control rod is capable of moving linearly along assembly axis A, but is not able of rotation relative to crankshaft 1140 (i.e., control rod 1140 rotates with crankshaft 1140). Movement of control rod 1160 along assembly axis A causes bearing block 1150 and nose pin 1122 to slide in arced channel 1152, thereby changing the angle β, and thus the piston stroke, as described, e.g., with reference to FIGS. 54 and 55 in PCT Application WO 03/100231.

Figure 11C:
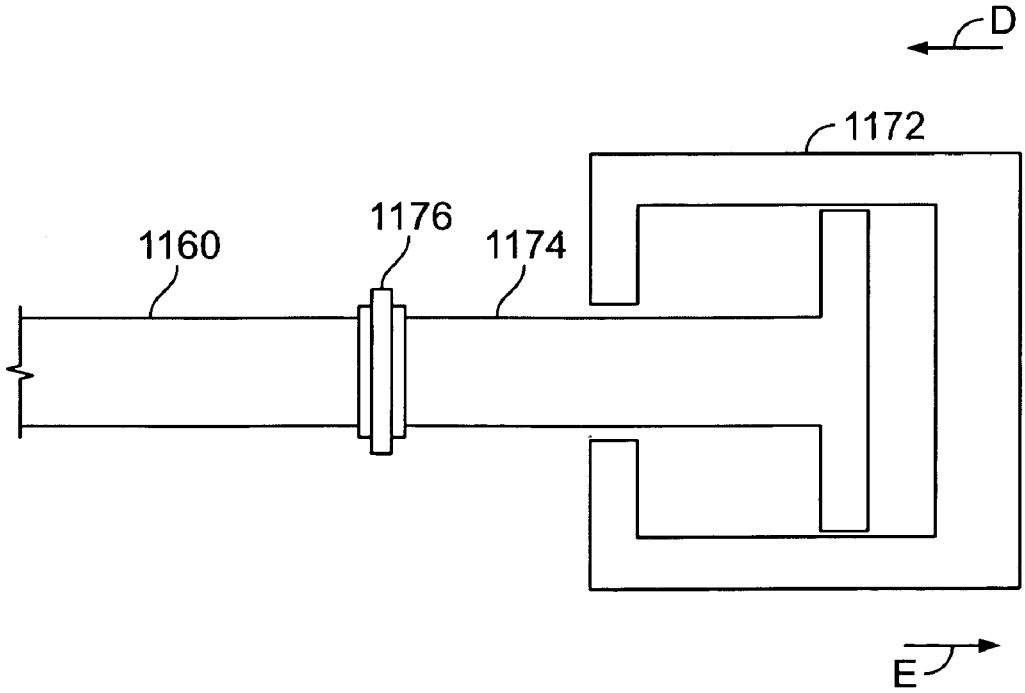
FIG. 11C is a side view of a mechanism for linearly moving the control rod of the hydraulic pump of FIGS. 11A and 11B.

Referring to FIG. 11C, a push/pull cylinder 1172 is used to linearly move control rod 1160 along assembly axis A. Push/pull cylinder 1172 includes a rod 1174 that is moved along assembly axis A by, e.g., hydraulics or spring actuation. Rod 1174 is connected to the end of control rod 1160 extending from crankshaft 1140 by a double-sided thrust bearing 1176. As rod 1174 is moved along assembly axis A in the direction of arrow D, control rod 1160 also is moved in this direction, resulting in the angle β increasing. As rod 1174 is moved in the direction of arrow E, piston forces act to move bearing block 1150 towards assembly axis A, which results in pinion gear 1156 and rack portion 1158 acting to move control rod 1160 in the direction of arrow E.

Referring again to FIGS. 11*a* and 11B, as flywheel 1130 rotates, push/pull cylinder 1148 is controlled such that rod 1164 moves U-joint 1110 and transition arm 1106 along assembly axis A to impart a linear motion to piston assemblies 1104 along piston axis P that is superimposed on the stroke of the pistons resulting from the generally circular motion of nose pin 1122 about assembly axis A.

Push/pull cylinder 1148 is controlled by a computer program executing on computer 1170 such that the desired piston waveforms are produced. For instance, to reduce ripple, the computer program emulates the additional linear motion imparted by cam 136 and cam follower 138 of hydraulic pump assembly 100 such that the additional linear motion imparted to piston assemblies 1104 by push/pull cylinder 1148 shapes the piston velocity waveforms to flatten peaks 302 and 304 by appropriately reducing or increasing the velocity of each piston assembly 1104.

The variable stroke control of hydraulic pump 1100 allows the output of pump 1100 to be increased or decreased, while imparting the additional linear motion to piston assemblies to flatten peaks 302 and 304 to reduce ripple in the output at the various output levels.

The cam profile implemented by the computer program can be adjusted dynamically during operation of pump 1100 when the stroke is varied. When the stroke is varied during operation of pump 1100, the position of control rod 1160 is sensed and fed back to the computer program, which then determines the new cam profile and controls push/pull cylinder 1148 appropriately.

Figure 12A:
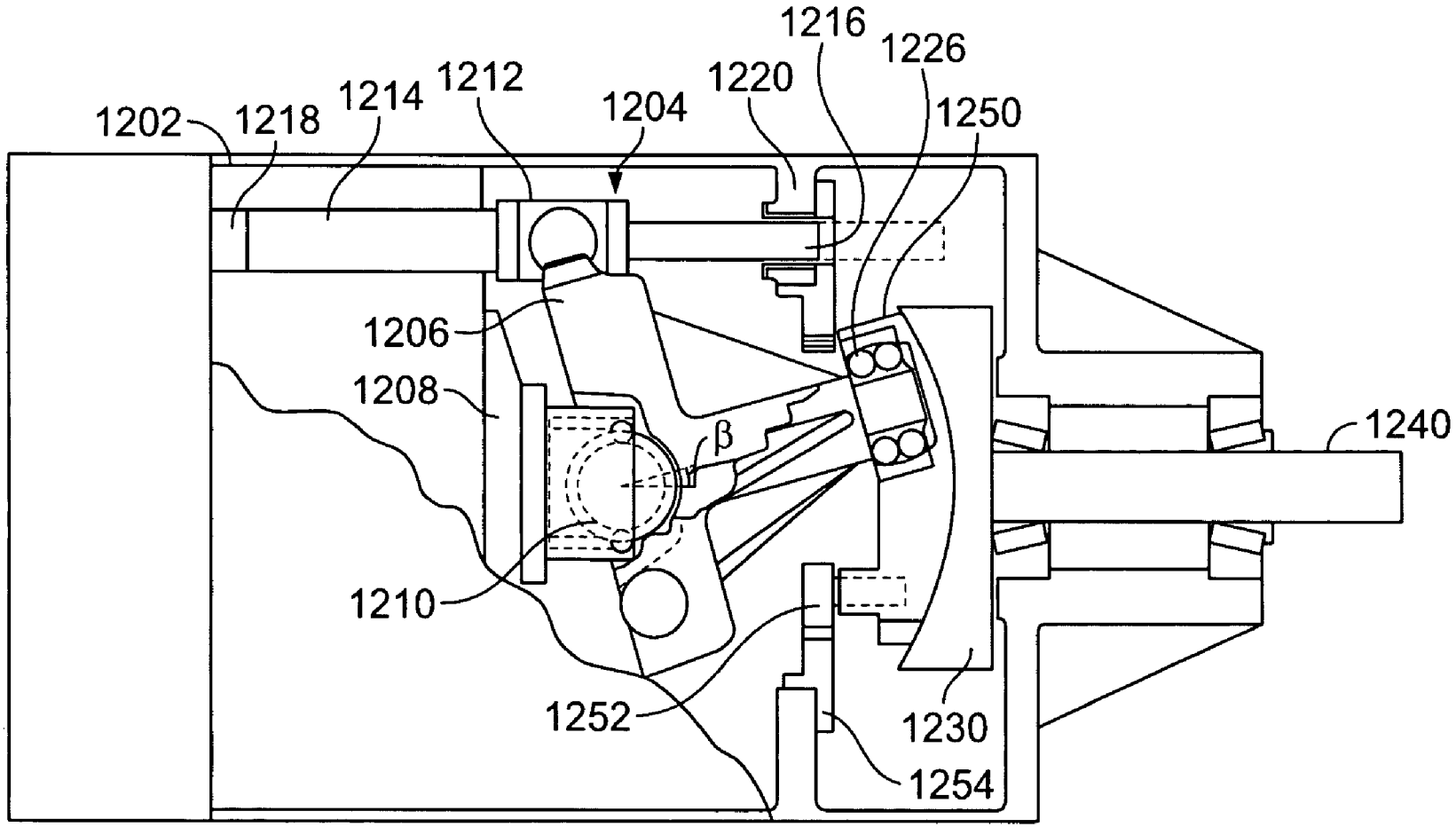
FIGS. 12A and 12B show side and frontal views, respectively, of an alternative hydraulic pump.
Figure 12B:
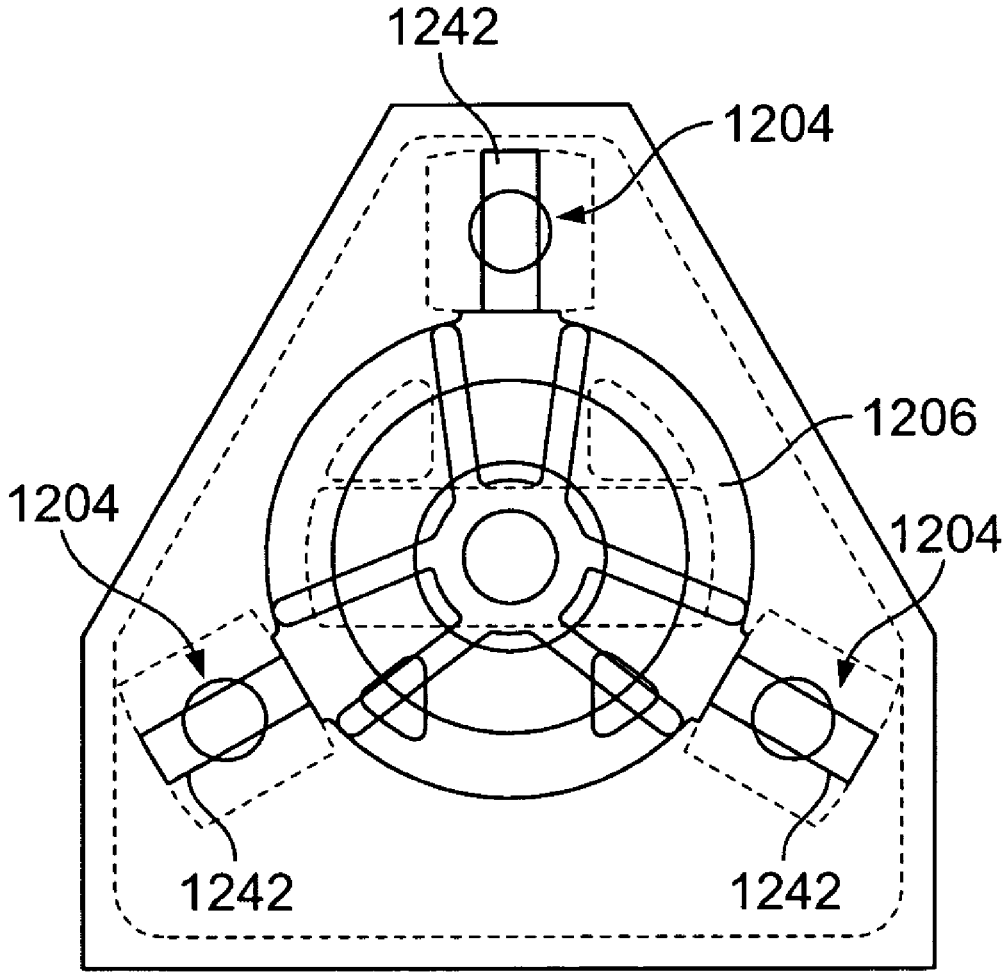

Referring to FIGS. 12A and 12B, in another implementation that employs a generally fixed stroke, the additional linear motion is imparted to pistons 1214 to shape the piston waveforms by adjusting the angle β. Transition arm 1206 includes a nose pin 1222 coupled to a bearing block 1250 via a self-aligning nose pin bearing 1226 contained in bearing block 1250 such that the transition arm 1206 is at an angle β with respect to assembly axis A. Bearing block 1250 mates with, e.g., a curved portion of a rotating member, e.g., a flywheel 1230, such that bearing block 1250 can slide along the curved portion of flywheel 1230. Movement of bearing block 1250 along the curved portion of flywheel 1230 causes nose pin 1222 to move in a manner that changes the angle β.

Bearing block 1250 is coupled to a cam follower 1252, e.g., a roller-type cam follower. Cam follower 1252 mates with a cam 1254, e.g., a face-cam. Cam 1254 is a cylindrical ring mounted to a flange 1220 such that cam 1254 mates with cam follower 1252 and is co-axial with flywheel 1230.

As flywheel 1230 rotates, cam follower 1252 follows a profile machined, e.g., into the face of cam 1254. The profile varies radially (i.e., to and away from assembly axis A) as cam follower 1252 travels along the profile such that, as the flywheel 1230 rotates, bearing block 1250 slides along the curved portion of flywheel 1230. Movement of bearing block 1250 causes the angle β to increase and decrease during each rotation of flywheel 1230. The increase and decrease of the angle β imparts a linear motion to piston assemblies 1204 along piston axis P that is superimposed on the piston stroke.

Because bearing block 1250 follows a curved path, there is side pressure on the sidewall of cam profile from cam follower 1252. However, because the amount of movement is generally small (a few percent of the full stroke), the side pressure is negligible, allowing the cam follower 1252 to follow the cam profile. The appropriate cam profile to achieve the desired piston or output waveforms can be determined by iteration, as described above.

While a cam and cam follower have been illustrated for adjusting the angle β to shape the piston waveforms, other mechanisms could be used to change the angle β appropriately.

Figure 13A:
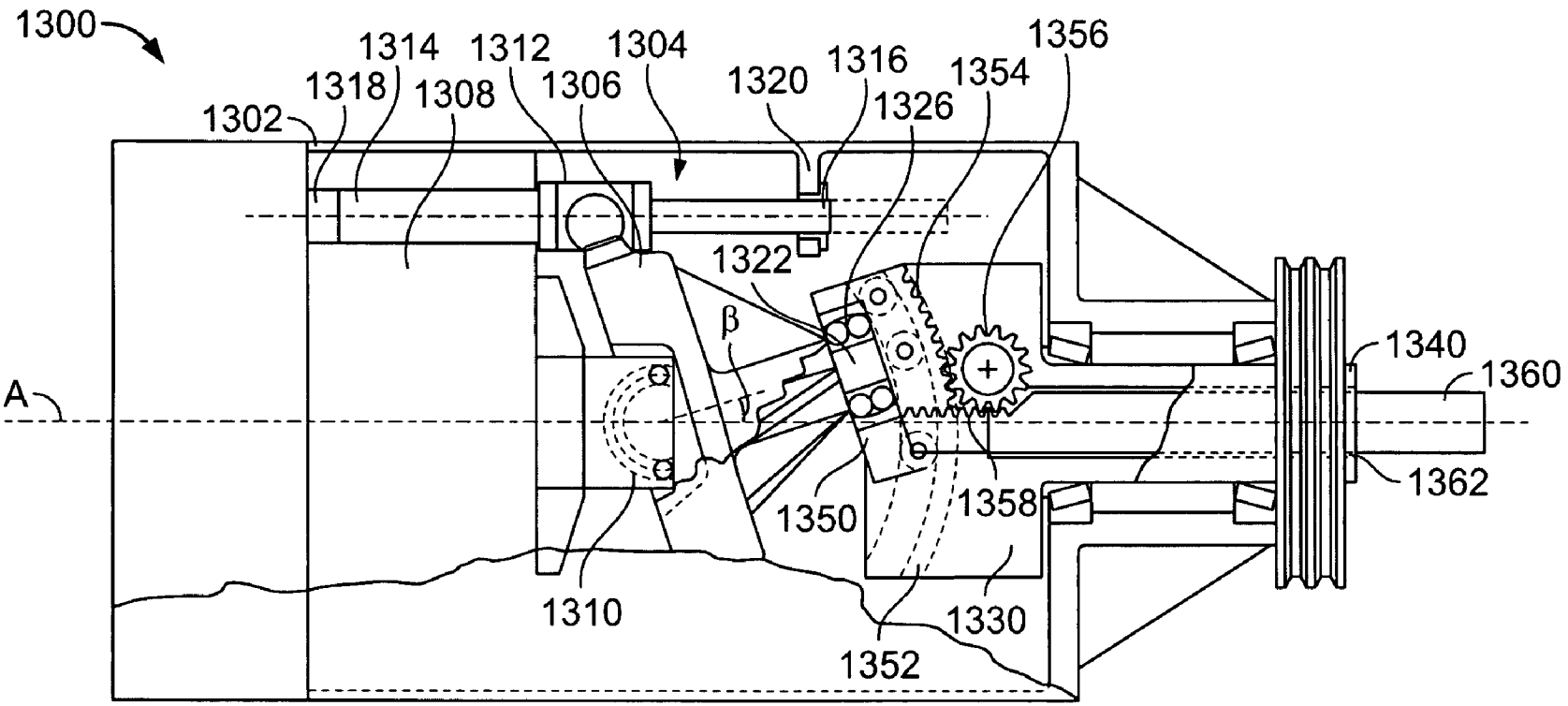
FIG. 13A shows a side view of an alternative hydraulic pump.
Figure 13B:
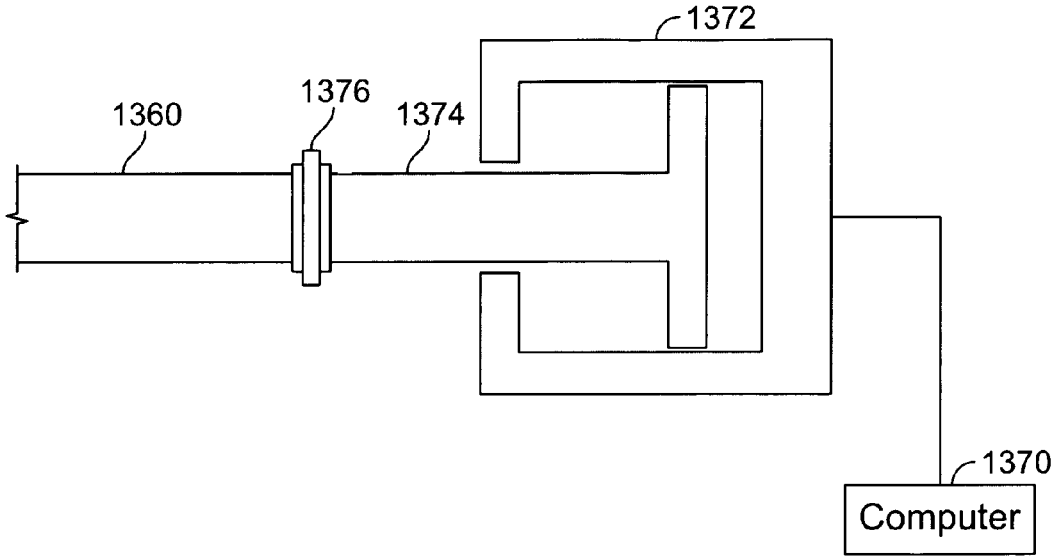
FIG. 13B shows a side view of a mechanism for linearly moving the control rod of the hydraulic pump of FIG. 13A.

Referring to FIGS. 13A and 13B, for example, a hydraulic pump assembly 1300 is similar to assembly 1100, except that that push/pull cylinder 1148 is removed and U-joint 1310 is mounted to a support 1308, as in assembly 1200, such that U-joint 1310 does not move linearly along assembly axis A. Instead, a push/pull cylinder 1372 is used to linearly move control rod 1360 along assembly axis A. Push/pull cylinder 1372 includes a rod 1374 that is moved along assembly axis A by, e.g., hydraulics or spring actuation. Rod 1374 is connected to the end of control rod 1360 extending from crankshaft 1340 by a double-sided thrust bearing 1376. Push/pull cylinder 1372 moves control rod 1360 in a similar manner as described with respect to push/pull cylinder 1172 in FIG. 11C.

Push/pull cylinder 1372 is connected to a computer 1370, which controls the actuation of push/pull cylinder 1372 so as to control the linear movement of rod 1374. Computer 1370 executes a program that appropriately controls push/pull cylinder 1372 so as to move control rod 1360 along assembly axis A while flywheel 1330 is rotating to thereby obtain the desired piston waveforms by causing the angle β to increase and decrease during each rotation of flywheel 1330.

While hydraulic pumps have been described, assemblies 100, 1100, 1200, and 1300, and their variations, can be adapted to act as other devices such as, for example, a hydraulic motor, an air compressor or air motor, an electric alternator or electric motor, or an internal combustion engine.

With respect to adapting assemblies 100, 1100, 1200, and 1300 and their variations to act as hydraulic motors, the corresponding benefit is that the piston waveforms can be controlled such that constant input pressure on the pistons is transferred to the output shaft with smooth torque vs. angular rotation. This is particularly important in certain fields where the vibration felt from the ripple of a hydraulic motor causes difficulty in control of the machinery affected. Normally, a large number of pistons is required to smooth out the torque to an acceptable value. When hydraulic fluid is used to actuated the pistons in assemblies 100, 1100, and 1200 (i.e., when assemblies 100, 1100, and 1200 are operated as a hydraulic motor), there may be little or no vibration and little or no torque variation with rotation. In addition, what is known as slip-stick in hydraulic motors can be reduced or eliminated because of the extraordinarily low friction of the transition arm conversion of reciprocating to rotary motion. Slip-stick makes small contracting machinery such as bulldozers, which are ordinarily driven by wobble-plate hydraulic motors, very difficult to control in slow motion and from a standing start.

Figure 14:
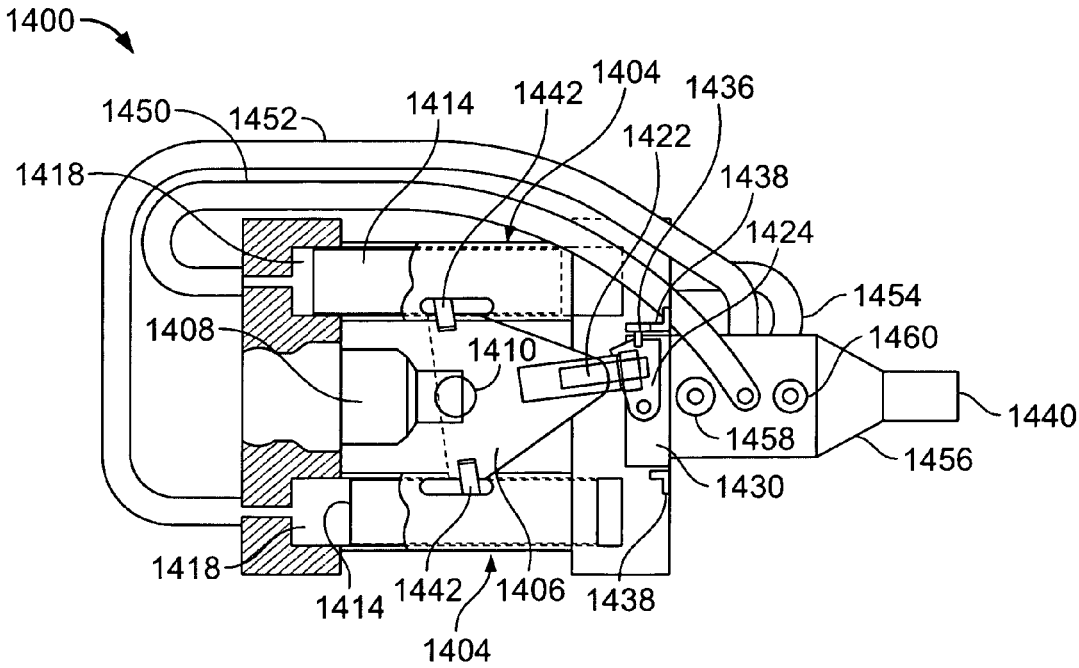
FIG. 14 is a side view of an air compressor or air motor.

Referring to FIG. 14A, assembly 100 is shown as adapted to be an air compressor or air motor 1400. A rotary valve 1456 is included on crankshaft 1440. Each cylinder 1418 is connected by hoses 1450, 1452, and 1454 to rotary valve 1456. To operate as an air compressor, crankshaft 1440 is rotated. As crankshaft 1440 is rotated, transition arm 1406 converts the rotational motion of flywheel 1430 into linear motion of pistons 1414. The linear motion of pistons 1414 sequentially draws air or other gaseous fluid into the cylinders 1418 from inlet port 1458 and exhausts the air from cylinders 1418 out exhaust port 1460. Rotary valve 1456 operates similar to the rotary valve described in FIGS. 17-19 in WO 03/100231 to control the flow of air to cylinders 1418, except that rotary valve 1456 is adapted for three cylinders.

As in assembly 100, U-joint 1410 is capable of linear movement, and pivot member 1424, cam follower 1436, and cam 1438 act to move U-joint 1410 linearly along assembly axis A to superimpose an additional linear motion on pistons 1414 that results in reduced ripple in the air output. Known air compressors generally deliver very irregular air flow, and may in fact have only one cylinder. This is typically dealt with through the installation of a large air tank that controls the air pressure downstream. The air compressor normally turns on and off at preset air pressure limits, so the application must be able to tolerate a range of pressure variation during operation. The design of a reduced-ripple air compressor such as air compressor 1400 makes possible at least a reduction in the size of the air tank required, if not its elimination. Since ripple is reduced, as in the hydraulic pump, even if resonance exists it is not excited. Vibration and noise are substantially reduced, as the mechanism can be well balanced, as described with respect to FIGS. 39-46 in PCT Application WO 03/100231.

By supplying air into inlet 1458, assembly 1400 acts as an air motor. Air is sequentially supplied from inlet port 1458 to each of the cylinders 1418 to move the pistons 1414 back and forth in the cylinders 1418. Transition arm 1406, attached to the pistons 1414 by drive pins 1442, is moved as a result and causes turn flywheel 129 and crankshaft 1440 to rotate. Air is exhausted from the cylinders 1418 out exhaust port 1460.

When assembly 1400 is operated as an air motor, the additional linear motion resulting from linearly displaceable U-joint 1410, pivot member 1424, cam follower 1436, and cam 1438 causes torque output of crankshaft 1440 to remain constant as the shaft turns (similar to the hydraulic motor described above), leading to better control in a number of applications, and eliminating one of the main objections to piston air motors. Also slip stick is reduced or cured, which is another problem with known piston driven air motors. Parts count and cost is lower owing to the need for fewer pistons as compared to a wobble plate air motor of the same size.

In other implementations, assembly 1400 employs the waveform shaping mechanisms described with respect to FIGS. 11A-13B.

Figure 15A:
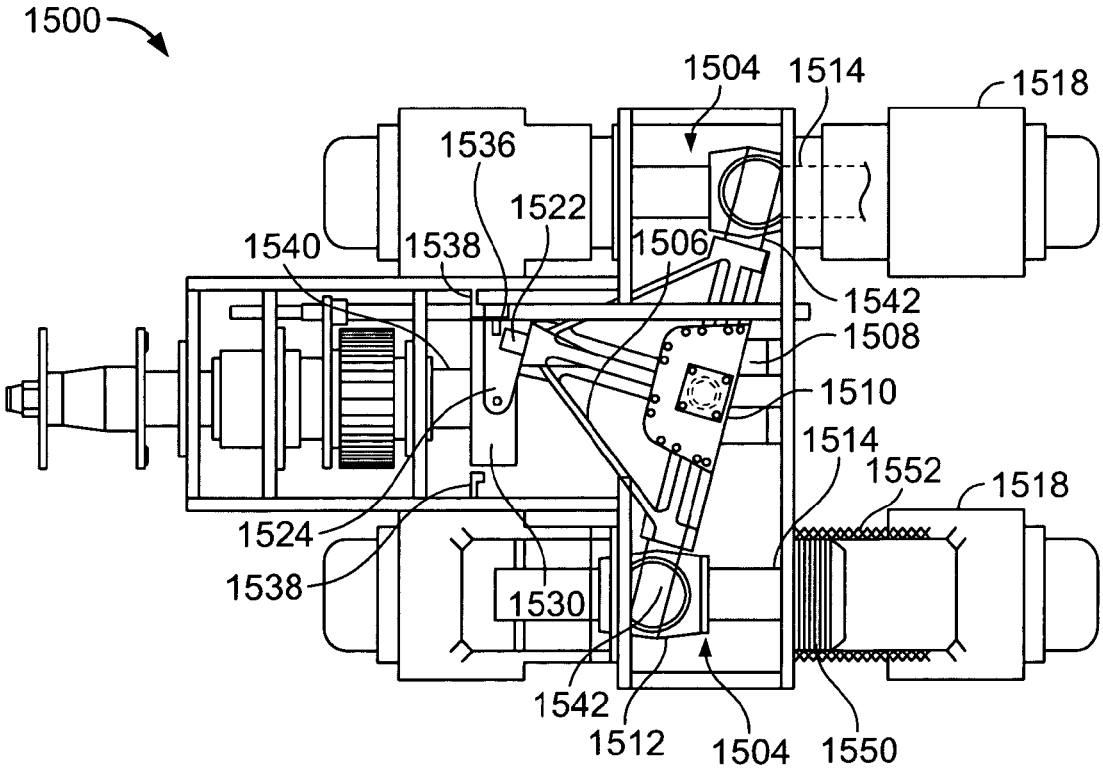
FIG. 15A is a side view of an alternator or electric motor.

Referring to FIG. 15A, assembly 100 is shown as adapted to be an alternator or motor 1500. Each piston 1514 terminates in a permanent magnet 1550 that reciprocates with the piston 1514. Each piston 1514 is housed within a non-magnetic cylinder 1518 having a coil 1552 located within the cylinder wall. Coils 1552 are wound circumferentially about magnets 1550. As a linear generator, rotation of flywheel 1530 causes reciprocating, linear motion of magnet 1550 such that alternating current (ac) is produced at coil 1552 at the revolving frequency of flywheel 1530.

With three 120° spaced cylinders 1518 the alternating current produced is three-phase. Since the motion of magnet 1550 is linear in space and sinusoidal in time and the voltage produced is proportional to the speed of the magnet, with three 120° spaced cylinders a coil winding having a uniform number of turns per inch produces a sinusoidal voltage output as long as the magnet remains within the coil during the reciprocating motion.

As in assembly 100, U-joint 1510 is capable of linear movement, and pivot member 1524, cam follower 1536, and cam 1538 act to move U-joint 1510 linearly along assembly axis A to superimpose an additional linear motion on pistons 1514 to shape the piston waveforms. The piston waveforms are shaped such that that the ac voltage and current waveforms substantially conform to that of a true sinewave.

Figure 15B:
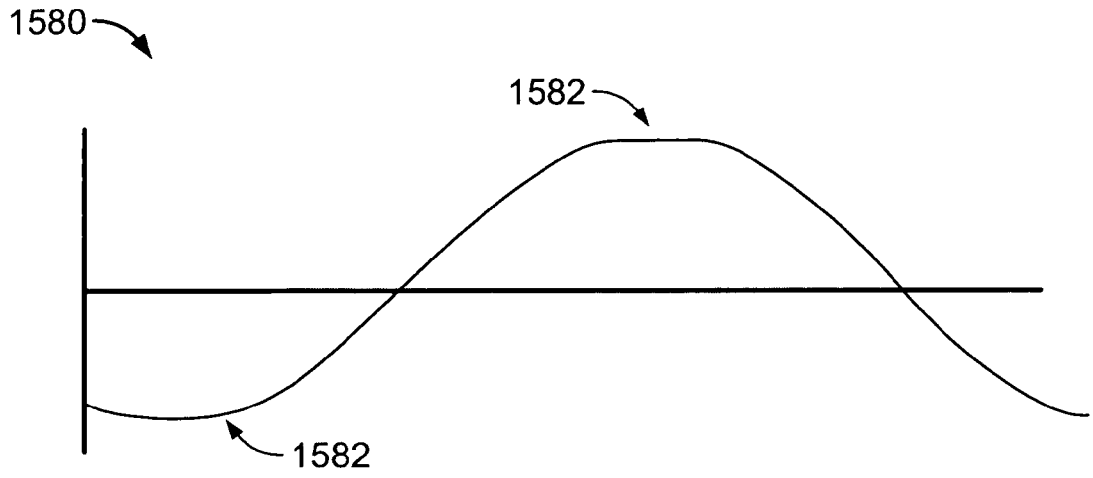
FIG. 15B shows an ac waveform of the alternator or electric motor of FIG. 15A without piston waveform shaping.

Referring to FIG. 15B, without shaping of the piston waveforms there is a slight flattening of the peaks 1582 of the ac waveforms 1580 due to the multiple turns of the coil and the finite length of the coil. The shape of the ac waveforms can be shaped some by adjusting the spacing between the windings of coils 1552 or changing the shape of magnets 1550. However, it is unlikely that ac waveforms substantially conforming to a truse sinewave can be obtain in this manner.

Figure 15C:
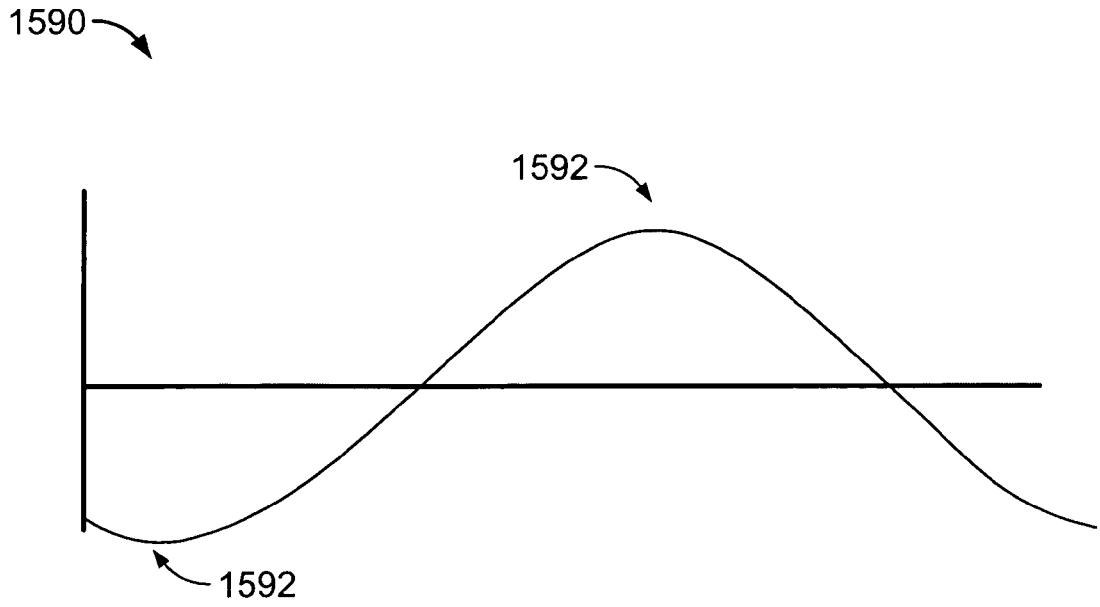
FIG. 15C shows an ac waveform of the alternator or electric motor of FIG. 15A with piston waveform shaping to substantially conform the ac waveform to that of a true sinewave.

Referring to FIG. 15C, the flattening of the peaks is eliminated in assembly 1500 by superimposing the additional linear motion on pistons 1514 to shape the piston waveforms to produce sinusoidal ac waveforms. The additional linear motion changes the position of the pistons as they approach the top of their stroke so that their movement at the top of their results in ac waveforms 1590 that whose peaks 1592 are more rounded so that the ac waveforms 1590 substantially conform to that of a true sine wave. This correction is on the order of one to three percent, depending on the angle swept out by the drive pins on the transition arm during one revolution.

Waveform correction in an alternator is beneficial since it can reduce or eliminate harmonics at the source. Harmonics can cause excess dissipation in electronic circuits, and normally require filtering to eliminate them either at the source or at the point of use. Small generators usually have poorer waveforms than larger generators, and the opportunity to generate improved waveform power with assembly 1500 simplifies many ac power installations.

By applying ac power to coils 1552, assembly 1500 acts as an electric motor. The ac power applied to coils 1552 causes pistons 1514 to reciprocate, which causes flywheel 1530 to rotate. When assembly 1500 is operated as an electric motor, the additional linear motion resulting from linearly displaceable U-joint 1410, pivot member 1424, cam follower 1436, and cam 1438 causes the piston movement to substantially conform to that of a true sinewave. This creates sinusoidal back emf, which in turn eliminates some sources of power loss in a motor. When the back emf of a motor is not matched to the input waveform, the motor speeds up and requires extra current when back emf is low, and vice versa. This energy devoted to speeding up and slowing down the motor within the space of each revolution is wasted energy, and piston waveform shaping prevents or reduces the occurrence of this condition.

In other implementations, assembly 1500 employs the waveform shaping mechanisms described with respect to FIGS. 1A-13B.

Figure 16A:
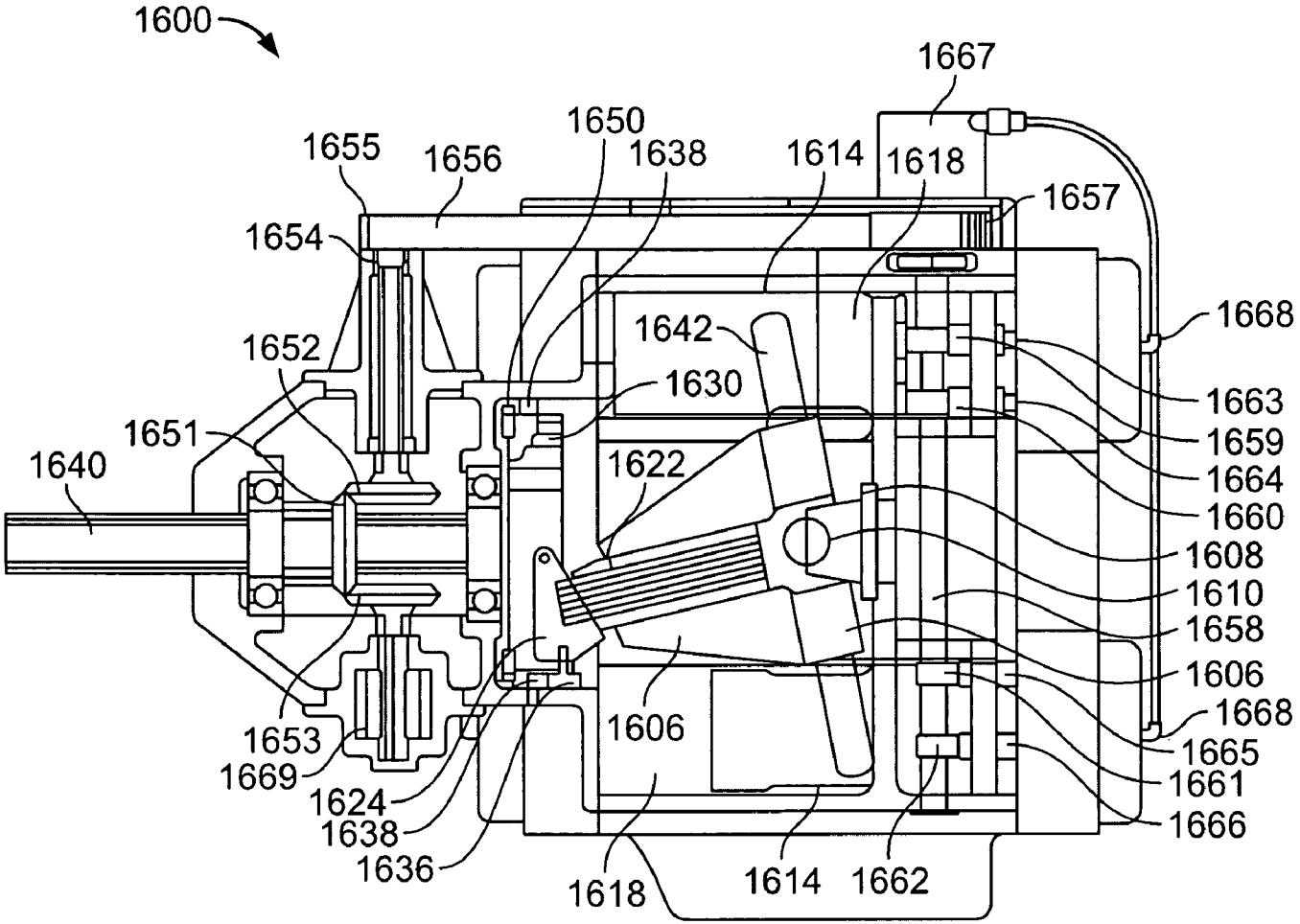
FIG. 16A is a side view of an internal combustion engine.

Referring to FIG. 16A, assembly 100 is shown as adapted to be a four cylinder internal combustion engine. Flywheel 1630 has gear teeth 1650 around one side which may be used for turning the flywheel 1630 with a starter motor to start the engine. The rotation of flywheel 1630 and crankshaft 1640 turns gear 1651, which in turn turns gears 1652 and 1653. Gear 1652 is attached to shaft 1654, which turns pulley 1655. Pulley 1655 is attached to belt 1656. Belt 1656 turns pulley 1657, which turns gears that rotate cam shaft 1658. Cam shaft 1658 has cams 1659 and 1660 on one end and cams 1661 and 1662 on the other end. Cams 1659 and 1660 actuate push rods 1663 and 1664, respectively. Cams 1661 and 1662 actuate push rods 1665 and 1666, respectively.

Push rods 1663, 1664, 1665, and 1666 open and close the intake and exhaust valves of the cylinders above the pistons. The left side of the engine, which has been cutaway, contains an identical, but opposite valve drive mechanism.

Pulley 1657 also turns gears that actuate distributor 1667. Distributor 1667 causes spark plugs to create a spark that ignites the gas-air mixture during the combustion phase.

Gear 1653 turned by gear 1651 on crankshaft 1640 turns pump 1669, which may be, for example, a water pump used in the engine cooling system (not illustrated), or an oil pump.

Figure 16B:
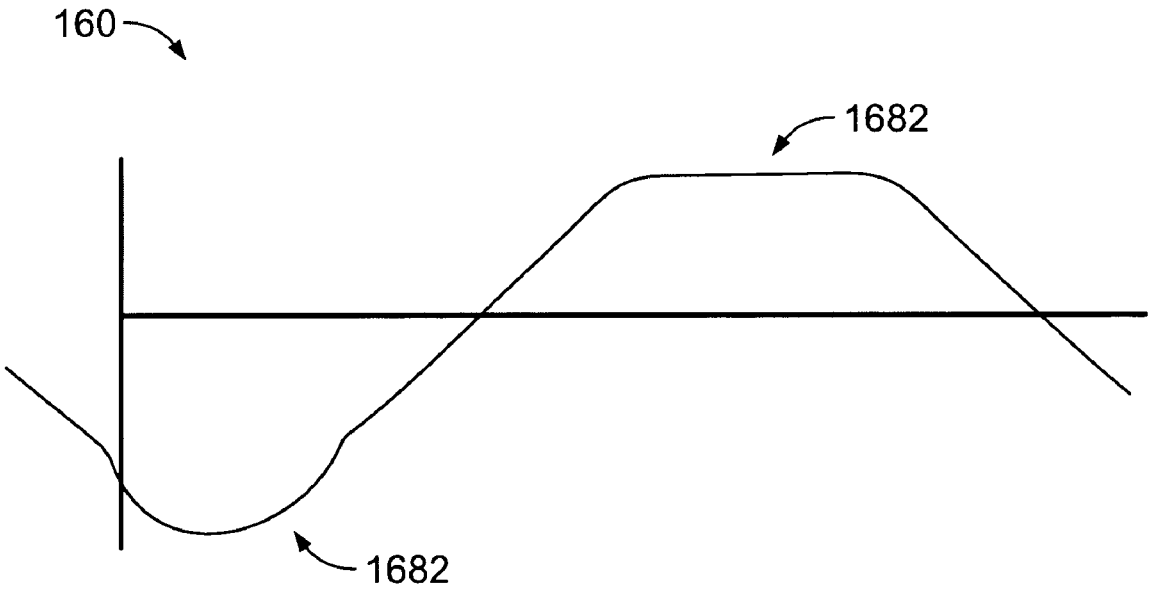
FIG. 16B shows a piston motion waveform in the internal combustion engine of FIG. 16A with waveform shaping to cause the piston to linger about top dead center during combustion.

Referring to FIG. 16B, as in assembly 100, U-joint 1610 is capable of linear movement, and pivot member 1624, cam follower 1636, and cam 1638 act to move U-joint 1610 linearly along assembly axis A to superimpose an additional linear motion on pistons 1614 to shape the piston waveforms. The piston waveforms 1680 are shaped so as to allow the piston to linger about top dead center (TDC) while the combustion process is completed, and then to slide down the cylinder in the power stroke. Staying near TDC minimizes the heat loss to the cylinder walls during combustion, since less wall is exposed to the full heat of combustion. To do so, the peak 1682 at the top of the piston stroke is flattened so that the combustion can then occur with the piston stationary at TDC, and then the power stroke begins at the point when the piston begins to ramp down. The flattening of the piston waveform peak 1682 for the other pistons results in the peak 1684 at the bottom of the piston stroke to differ from that of a sinewave.

Timing the ignition in such an assembly means igniting the mixture at the point that is the time the power stroke begins minus the number of milliseconds required to allow complete combustion to occur at TDC, as opposed to the timing in normal crankshaft engines, in which the mixture is ignited at a time prior to TDC while the piston is still on its compression stroke. Igniting the mixture before TDC is disadvantageous because some of the combustion energy is directed to turning the engine backwards.

Another advantage of flat top waveforms in an internal combustion engine is that the combustion process can remain unchanged with respect to engine rpm. Normally as the rpm increases, the spark timing is advanced to allow time for combustion to occur before TDC by a specified number of milliseconds. As the rpm increases, the specified number of milliseconds corresponds to a greater number of degrees of the crankshaft. Thus, the spark occurs earlier on the compression stroke, and therefore tends to turn the engine backwards. With a flat top piston waveform 1680, the combustion chamber has the same volume during combustion and, as the rpm increases, the spark is timed to occur earlier along the flat top 1682, which does not change the combustion process. In other words, the spark can occur at a fixed time before the corner of the flat top 1682 is reached over a wide range of rpm, without lapping over into the compression stroke.

In other implementations, assembly 1600 employs the waveform shaping mechanisms described with respect to FIGS. 11A-13B.

A number of implementations have been described. Nevertheless, it will be understood that various modifications may be made. For example, while described as using three pistons, more or less than three pistons may be used, e.g., one, two, four or six. Also, while a constant velocity u-joint has been described, other U-joints, whether constant velocity, near-constant velocity, or non-constant velocity can be used. In addition, while single-ended pistons have been shown, double-ended pistons can be used. Accordingly, other implementations are within the scope of the following claims.

What is claimed is:

1. An assembly comprising:

at least one piston;

a rotating member;

a transition arm coupled to the at least one piston and the rotating member to translate between rotational movement of the rotating member and a first linear motion of the piston; and a mechanism configured to superimpose a second linear motion of the piston onto the first linear motion of the piston, wherein the mechanism comprises:

a cam;

a cam-follower coupled to the rotating member and the transition arm, the cam-follower configured to engages the cam during rotational movement of the rotating member; and a pivot member, wherein the pivot member coupled the cam-follower to the rotating member and the transition arm, the pivot member configured to linearly move the transition arm as the cam-follower engages the cam during rotational movement of the rotating member, the linear movement of the transition arm resulting in the second linear motion superimposed on the first linear motion of the piston.

2. The assembly of claim 1 wherein the assembly is an air compressor, and the first linear motion and the second linear motion result in a combined linear motion of the piston that reduces ripple in an output of the air compressor.

3. The assembly of claim 1 wherein the assembly is an air motor, and the first linear motion and the second linear motion result in a combined linear motion of the piston that reduces ripple in an output torque of the air motor.

4. The assembly of claim 1 wherein the assembly is an alternator, and the first linear motion and the second linear motion result in a combined linear motion of the piston that conforms substantially to that of a true sine wave.

5. The assembly of claim 1 wherein the assembly is an electric motor, and the first linear motion and the second linear motion result in a combined linear motion of the piston that creates substantially sinusoidal back emf.

6. The assembly of claim 1 wherein the assembly is an internal combustion engine that includes a combustion process, and the first linear motion and the second linear motion result in a combined linear motion of the piston in which the piston is stationary at top dead center while the combustion process is completed.

7. An assembly comprising:

at least one piston;

a rotating member;

a transition arm coupled to the at least one piston and the rotating member to translate between rotational movement of the rotating member and a first linear motion of the piston; and a mechanism configured to superimpose a second linear motion of the piston onto the first linear motion of the piston, wherein the mechanism comprises a push/pull cylinder coupled to the transition arm, the push/pull cylinder configured to linearly move the transition arm during rotational movement of the rotating member, the linear movement of the transition arm resulting in the second linear motion superimposed on the first linear motion of the piston;

a computer configured to control the push/pull cylinder to linearly move the transition arm; and a control rod to adjust piston stroke of the piston.

8. A method comprising:

superimposing a second linear motion onto a first linear motion of a piston in an assembly, wherein the first linear motion and the second linear motion produce a combined linear motion of the piston that results in a shaped piston waveform;

changing a stroke of the piston to a new stoke; and changing the second linear motion to produce a new combined linear motion of the piston that that results in the shaped piston waveform.

9. The method of claim 8 wherein changing a stroke of the piston to a new stoke comprises changing an angle between the transition arm and a rotation axis of the rotating member.

10. The method of claim 8 wherein the assembly is an alternator and the first linear motion and the second linear motion produce a combined linear motion of the piston that conforms substantially to that of a true sine wave.

11. The method of claim 8 wherein the assembly is an electric motor and the first linear motion and the second linear motion produce a combined linear motion of the piston that creates substantially sinusoidal back emf.

12. The method of claim 8 wherein the assembly is an internal combustion engine that includes a combustion process and the first linear motion and the second linear motion produce a combined linear motion of the piston that results in the piston being stationary at top dead center while the combustion process is completed.

13. A method comprising:

superimposing a second linear motion onto a first linear motion of a piston in an assembly, wherein the assembly is a hydraulic pump and the first linear motion and the second linear motion produce a combined linear motion of the piston that reduces ripple in an output of the hydraulic pump.

14. The method of claim 13 wherein superimposing a second linear motion comprises linearly moving the transition arm during rotational movement of the rotating member.

15. The method of claim 13 wherein superimposing a second linear motion comprises angularly moving the transition arm during rotational movement of the rotating member.

16. A method comprising:

superimposing a second linear motion onto a first linear motion of a piston in an assembly, wherein the assembly is an air compressor and the first linear motion and the second linear motion produce a combined linear motion of the piston that reduces ripple in an output of the air compressor.

17. A method comprising:

superimposing a second linear motion onto a first linear motion of a piston in an assembly, wherein the assembly is an air motor and the first linear motion and the second linear motion produce a combined linear motion of the piston that reduces ripple in an output torque of the air motor.

18. A hydraulic pump comprising:

at least one piston;

a rotating member;

a transition arm coupled to the at least one piston and the rotating member translate between rotational movement of the rotating member and a first linear motion of the piston; and a mechanism configured to superimpose a second linear motion of the piston onto the first linear motion of the piston, wherein the first linear motion and the second linear motion result in a combined linear motion of the piston that reduces ripple in an output of the hydraulic pump.

19. The hydraulic pump of claim 18 wherein the mechanism comprises:

a cam; and a cam-follower coupled to the rotating member and the transition arm, the cam-follower configured to engage the cam during rotational movement of the rotating member.

20. The hydraulic pump of claim 19 wherein the mechanism further comprises a pivot member, wherein the pivot member couples the cam-follower to the rotating member and the transition arm, the pivot member configured to linearly move the transition arm as the cam-follower engages the cam during rotational movement of the rotating member, the linear movement of the transition arm resulting in the second linear motion superimposed on the first linear motion of the piston.

21. The hydraulic pump of claim 19 wherein the mechanism further comprises a bearing block, wherein the bearing block couples the cam-follower to the rotating member and the transition arm, the bearing block configured to angularly move the transition arm as the cam-follower engages the cam during rotational movement of the rotating member, the angular movement of the transition arm resulting in the second linear motion superimposed on the first linear motion of the piston.

22. The hydraulic pump of claim 18 wherein the mechanism comprises a push/pull cylinder coupled to the transition arm, the push/pull cylinder configured to linearly move the transition arm during rotational movement of the rotating member, the linear movement of the transition arm resulting in the second linear motion superimposed on the first linear motion of the piston.

23. The hydraulic pump of claim 22 further comprising a computer configured to control the push/pull cylinder to linearly move the transition arm.

24. The hydraulic pump of claim 23 further comprising a control rod to adjust piston stroke of the piston.

25. The hydraulic pump of claim 24 wherein the computer is configured to control the push/pull cylinder to linearly move the transition arm based on the piston stroke of the piston.

26. The hydraulic pump of claim 18 wherein:

the at least one piston comprises three pistons;

the transition arm is coupled to the pistons such that the pistons are arranged circumferentially about the transition arm, the transition arm including a nose pin; and the rotating member has a rotation axis, the nose pin being coupled to the rotating member off-axis of the rotating member to form an angle between the transition arm and the rotation axis such that rotational movement of the rotating member is translated into a first linear motion of each piston.

27. The hydraulic pump of claim 26 wherein the mechanism comprises:

a substantially cylindrical cam mounted substantially coaxially with the rotation axis, the cam including a cam profile that varies along the rotation axis;

a cam-follower configured to engage the cam profile during rotational movement of the rotating member;

a pivot member coupled to the rotating member, wherein the pivot member couples the nose pin to the rotating member; and wherein the cam-follower is coupled to the pivot member such that the pivot member pivots as the cam-follower engages the cam profile during rotational movement of the rotating member, the pivoting of the pivot member causing linear movement of the transition arm that results in the second linear motion of the piston

28. The hydraulic pump of claim 26 wherein the mechanism comprises:

a substantially cylindrical cam mounted substantially coaxially with the rotation axis, the cam including a cam profile that varies along an axis perpendicular to the rotation axis;

a cam-follower configured to engage the cam profile during rotational movement of the rotating member;

a bearing block housed in an arced channel defined by the rotating member, wherein the bearing block couples the nose pin to the rotating member; and wherein the cam-follower is coupled to the bearing block such that the bearing block slides in the arced channel as the cam-follower engages the cam profile during rotational movement of the rotating member, the sliding of the bearing block causing angular movement of the transition arm that results in the second linear motion of the piston.

29. The hydraulic pump of claim 26 further comprising:

a bearing block housed in an arced channel defined by the rotating member, wherein the bearing block couples the nose pin to the rotating member; and a control rod coupled to the bearing block such that movement of the control rod slides the bearing block in the arced channel to change the angle between the transition arm and the rotational axis, wherein the change in angle between the transition arm and the rotational axis changes a piston stroke of the pistons.

30. The hydraulic pump of claim 29 wherein the mechanism comprises a push/pull cylinder coupled to the transition arm, the push/pull cylinder configured to linearly move the transition arm during rotational movement of the rotating member, the linear movement of the transition arm resulting in the second liner motion of the piston.

31. The hydraulic pump of claim 30 further comprising a computer configured to control the push/pull cylinder to linearly move the transition arm based on the piston stroke of the pistons.

32. A hydraulic pump comprising:

at least one piston;

a rotating member;

a transition arm coupled to the at least one piston and the rotating member to translate between rotational movement of the rotating member and a first linear motion of the piston; and means for shaping the linear motion of the piston to reduce ripple in an output of the hydraulic pump.

33. An air compressor comprising:

at least one piston;

a rotating member;

a transition arm coupled to the at least one piston and the rotating member to translate between rotational movement of the rotating member and a first linear motion of the piston; and a mechanism configured to superimpose a second linear motion of the piston onto the first linear motion of the piston, wherein the first linear motion and the second linear motion result in a combined linear motion of the piston that reduces ripple in an output of the air compressor.

34. The air compressor of claim 33 wherein the mechanism comprises:

a cam; and a cam-follower coupled to the rotating member and the transition arm, the cam-follower configured to engage the cam during rotational movement of the rotating member.

35. The air compressor of claim 34 wherein the mechanism further comprises a pivot member, wherein the pivot member couples the cam-follower to the rotating member and the transition arm, the pivot member configured to linearly move the transition arm as the cam-follower engages the cam during rotational movement of the rotating member, the linear movement of the transition arm resulting in the second linear motion superimposed on the first linear motion of the piston.

36. The air compressor of claim 33 wherein the mechanism comprises a push/pull cylinder coupled to the transition arm, the push/pull cylinder configured to linearly move the transition arm during rotational movement of the rotating member, the linear movement of the transition arm resulting in the second linear motion superimposed on the first linear motion of the piston.

37. The air compressor of claim 36 further comprising a computer configured to control the push/pull cylinder to linearly move the transition arm.

38. An air motor comprising:

at least one piston;

a rotating member;

a transition arm coupled to the at least one piston and the rotating member to translate between rotational movement of the rotating member and a first liner motion of the piston; and a mechanism configured to superimpose a second linear motion of the piston onto the first linear motion of the piston, wherein the first linear motion and the second linear motion result in a combined linear motion of the piston that reduces ripple in an output torque of the air motor.

39. The air motor of claim 38 wherein the mechanism comprises:

a cam; and a cam-follower coupled to the rotating member and the transition arm, the cam-follower configured to engage the cam during rotational movement of the rotating member.

40. The air motor of claim 39 wherein the mechanism further comprises a pivot member, wherein the pivot member couples the cam-follower to the rotating member and the transition arm, the pivot member configured to linearly move the transition arm as the cam-follower engages the cam during rotational movement of the rotating member, the linear movement of the transition arm resulting in the second linear motion superimposed on the first linear motion of the piston.

41. The air motor of claim 38 wherein the mechanism comprises a push/pull cylinder coupled to the transition arm, the push/pull cylinder configured to linearly move the transition arm during rotational movement of the rotating member, the linear movement of the transition arm resulting in the second linear motion superimposed on the first linear motion of the piston.

42. The air motor of claim 41 further comprising a computer configured to control the push/pull cylinder to linearly move the transition arm.

* * * * *

UNITED STATES PATENT AND TRADEMARK OFFICE

CERTIFICATE OF CORRECTION

PATENT NO. : 7,438,029 B2
APPLICATION NO. : 10/944822
DATED : October 21, 2008
INVENTOR(S) : John Fox It is certified that error appears in the above-identified patent and that said Letters Patent is hereby corrected as shown below:

In the claims:

Page 7, column 13, line 3, in claim 1 change “engages” to --engage--.

Page 7, column 13, line 5, in claim 1 change “coupled” to --couples--.

Page 7, column 13, line 61, in claim 8 change “stoke;” to --stroke;--.

Page 7, column 13, line 66, in claim 9 change “stoke” to --stroke--.

Page 7, column 14, line 46, in claim 18 change “member translate” to --member to translate--.

Page 8, column 15, line 54, in claim 27 change “piston” to --piston.--.

Page 8, column 16, line 21, in claim 30 change “liner” to --linear.--.

Page 9, column 17, line 13, in claim 38 change “liner” to --linear.--.

Signed and Sealed this

Twenty-sixth Day of May, 2009

JOHN DOLL
*Acting Director of the United States Patent and Trademark Office*